US011247811B1

(12) United States Patent
Snell

(10) Patent No.: US 11,247,811 B1
(45) Date of Patent: Feb. 15, 2022

(54) BINS THAT CONNECT TO PREVENT LATERAL MOVEMENT

(71) Applicant: InterDesign, Inc., Solon, OH (US)

(72) Inventor: Russell Benton Snell, Bentleyville, OH (US)

(73) Assignee: InterDesign, Inc., Solon, OH (US)

( * ) Notice: Subject to any disclaimer, the term of this patent is extended or adjusted under 35 U.S.C. 154(b) by 35 days.

(21) Appl. No.: 15/243,272

(22) Filed: Aug. 22, 2016

Related U.S. Application Data

(63) Continuation-in-part of application No. 29/571,044, filed on Jul. 14, 2016, now Pat. No. Des. 846,220, which is a continuation-in-part of application No. 29/542,998, filed on Oct. 20, 2015, now Pat. No. Des. 817,659.

(60) Provisional application No. 62/208,215, filed on Aug. 21, 2015.

(51) Int. Cl.
*B65D 21/02* (2006.01)
*B65D 25/04* (2006.01)

(52) U.S. Cl.
CPC ..... *B65D 21/0202* (2013.01); *B65D 25/04* (2013.01)

(58) Field of Classification Search
CPC . B65D 21/0202; B65D 25/04; B65D 21/0204
USPC ..... 220/23.4, 23.2
See application file for complete search history.

(56) References Cited

U.S. PATENT DOCUMENTS 4,889,254 A * 12/1989 Vola ..... A45C 7/0045 220/23.4
5,413,236 A * 5/1995 Kenevan ..... B65D 11/18 220/23.4
D374,998 S * 10/1996 Ko ..... D6/659
7,311,202 B2 * 12/2007 Chen ..... A47B 87/0292 206/503
9,290,300 B2 * 3/2016 Hendrickson ..... B65D 23/00
2008/0217340 A1 * 9/2008 Jager ..... B65D 21/0204 220/524

* cited by examiner

*Primary Examiner* — Jeffrey R Allen
(74) *Attorney, Agent, or Firm* — Calfee, Halter & Griswold LLP

(57) ABSTRACT

Bins that are capable of connecting to other bins to prevent relative lateral movement of connected bins and/or improved means for connecting bins. The bins can connect via the top, the bottom, or any other location.

16 Claims, 37 Drawing Sheets

BINS THAT CONNECT TO PREVENT LATERAL MOVEMENT

CROSS REFERENCE TO RELATED APPLICATIONS

This application claims priority to, and any other benefit of, U.S. Provisional Patent Application Ser. No. 62/208,215, filed on Aug. 21, 2015, and entitled BINS THAT CONNECT TO PREVENT LATERAL MOVEMENT, which application is hereby incorporated by reference in its entirety, except where directly conflicting with the present application. This application is a continuation-in-part of U.S. Design Patent Application Serial No. 29/571,044 filed on Jul. 14, 2016 and entitled ITEMS, and a continuation-in-part of U.S. Design Patent Application Serial No. 29/542,998 filed on 20 Oct. 2015, and also entitled ITEMS, which applications are hereby incorporated by reference in its entireties, except where directly conflicting with the present application.

BACKGROUND

It is known to make bins out of plastic. Applicants have determined that there is ample room for improvement of the functionality of such bins.

SUMMARY

The present application discloses bins that are capable of connecting to other bins to prevent relative lateral movement of connected bins and/or improved means for connecting bins.

In some exemplary embodiments, a bin capable of connecting to other bins to prevent relative lateral movement comprises: a base having at least first, second, third, and fourth sides; at least first, second, and third side walls extending up from first, second, and third sides of the base; wherein one of the first side wall and the base on the first side has a first connector of a first type; wherein one of the second side wall and the base on the second side has a second connector of a first type; wherein one of the third side wall and the base on the third side has a third connector of a first type; and wherein one of the base on its fourth side and an optional fourth side wall has a connector of a second type, wherein connectors of the first type connect to connectors of the second type to prevent relative lateral movement of connected bins.

In some exemplary embodiments, a bin capable of connecting to other bins to prevent relative lateral movement comprises: a base having at least first, second, and third sides; at least first and second side walls extending up from first and second sides of the base; wherein one of the first side wall and the base on the first side has a first connector of a first type; wherein one of the second side wall and the base on the second side has a second connector of a first type; and wherein one of the base on its third side and an optional third side wall has a connector of a second type, wherein connectors of the first type connect to connectors of the second type to prevent relative lateral movement of connected bins.

In exemplary four-sided bins, having the same type of connector on three sides and the other type of connector on the fourth side facilitates putting the pieces in different configurations and gives a clean look to the assembled collection of bins (no extraneous male connectors around the perimeter of the assembled collection). Exemplary four-sided bins have female connectors on three sides and male connectors on one side. Other exemplary four-sided bins could possibly have male connectors on three sides and female connectors on one side, but that might have male connectors on three exposed sides of the connected, combined unit and might make full rectangular collections impossible. Exemplary three-sided bins have the same type of connector on two sides and the other type of connector on the third side. Thus, exemplary three-sided bins have female connector on two sides and a male connector on the third side. Bins with a different number of sides are possible; in some exemplary N-sided embodiments, there would be N−1 female connectors and one male connector.

In some exemplary four-sided bins, having a continuous female connector on all four sides and the other type of connector on one side facilitates putting the pieces in different configurations and gives a clean look to the assembled collection of bins. Exemplary four-sided bins have a continuous female connector on all four sided and a male connector on one side. Other exemplary four-sided bins could possibly have male connectors on more than one side. Bins with a different number of sides are possible; in general, in some exemplary embodiments, the female side would be continuous and there would be one or more male connectors.

DETAILED DESCRIPTION

Figure 1:
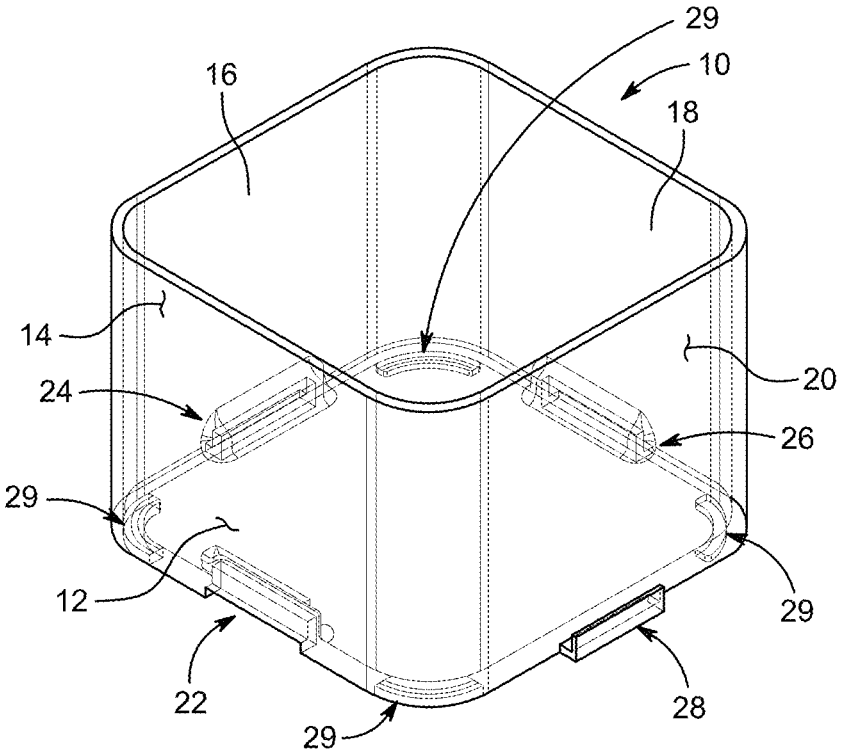
FIGS. 1-5 are various views of a first exemplary bin according to the present application, i.e., a front/right/top perspective view (FIG. 1), a front elevational view (FIG. 2), a top plan view (FIG. 3), a right side elevational view (FIG. 4), a sectional view (FIG. 5) taken along section line A-A of FIG. 4, respectively.

This Detailed Description merely describes exemplary embodiments of the invention and is not intended to limit the scope of the claims in any way. Indeed, the invention as claimed is broader than and unlimited by the preferred embodiments, and the terms used in the claims have their full ordinary meaning.

Exemplary bins are shown herein. A first type of exemplary bin as shown in FIGS. 1-35. In this first type of bin, connectors are shown as proximate the bottom of the bins. A second type of exemplary bin is shown in FIGS. 36-64. In the second type of bin, connectors are shown proximate the top of the bins.

The present application discloses bins that are capable of connecting to other bins to prevent relative lateral movement of connected bins and/or improved means for connecting bins. Referring now to FIGS. 1-9, an exemplary bin 10 capable of connecting to other bins to prevent relative lateral movement comprises: a base 12 (in this case the bottom of the bin) having at least first, second, and third sides and at least a first wall 14, a second wall 16, and a third wall 18 extending up from first, second, and third sides of the base 12. Optionally, if the bin is a four-sided bin, the base 12 has a fourth side and the bin 10 would have a fourth wall 20. In exemplary embodiments, one of the first side wall 14 and the base 12 on the first side has a first connector 22 of a first type, such as a female connector, one of the second side 16 and the base 12 on the second side has a second connector 24 of the first type; one of another side wall and the base 12 on another side has a third connector 26 of the first type, e.g., a male connector. Some exemplary embodiments are three-sided bins with two female connectors and one male connector. In the exemplary four-sided embodiment of FIG. 1, one of the first side wall 14 and the base 12 on the first side has a first connector 22 of a first type, such as a female connector, one of the second side 16 and the base 12 on the second side has a second connector 24 of the first type; one of the third side wall 18 and the base 12 on the third side has a third connector 26 of the first type; and one of the fourth wall 20 and the base on its fourth side has a connector 28 of a second type, such as a male connector. Connectors of the first type 22, such as a female connector, connect to connectors of the second type 28, such as a male connector, to prevent relative lateral movement of connected bins. @@Optionally, the bin 10 can include feet 29. In the current embodiment, the feet 29 are in the corners of the bin 10. However, the feet 29, could be smaller or larger than pictured and could be at any point along the bottom 12 of the bin 10 or extend around the entire perimeter along the bottom 12 of the bin 10. Exemplary bins have an open top, exemplified by opening 30.

Figure 2:
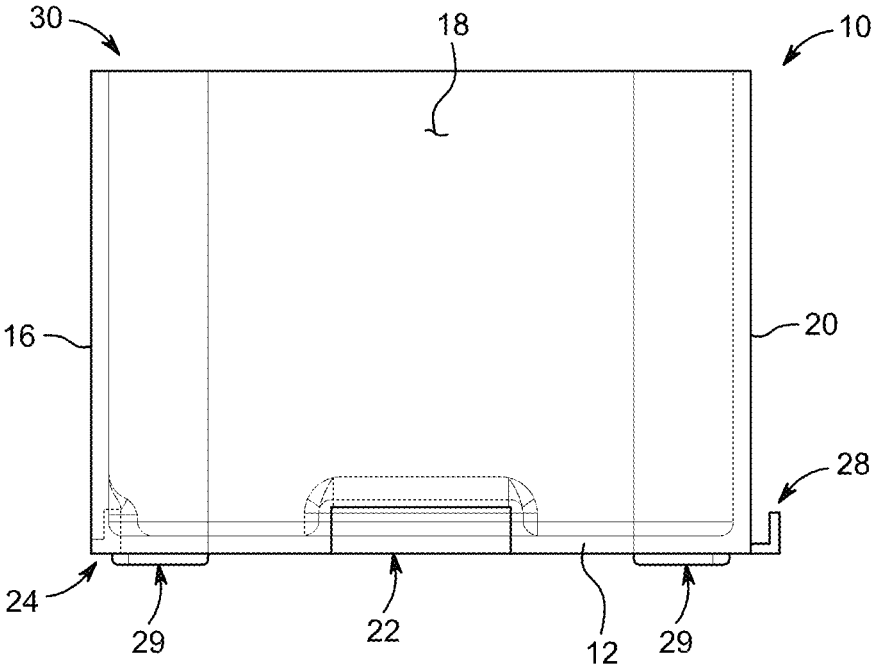

FIG. 2 is a front elevational view of the first exemplary bin 10 according to the present application. The female connectors 22, 24 of certain exemplary embodiments are shown at the left and facing the reader and the male connector 28 of certain embodiments is shown at the right. Other configurations of male connectors 28 and female connectors 24 can be used. For example, the male connector 28 can be arranged on a side of the base 10 adjacent to the side including the female connector 24. The bin 10 could be used to store items that could be placed inside the bin 10 via the opening 30. In some exemplary embodiments, the exemplary male connector 28 is an L-shaped flange that extends proximate to the bottom 12 of the bin 10, extending outward horizontally and upwards vertically.

Figure 3:
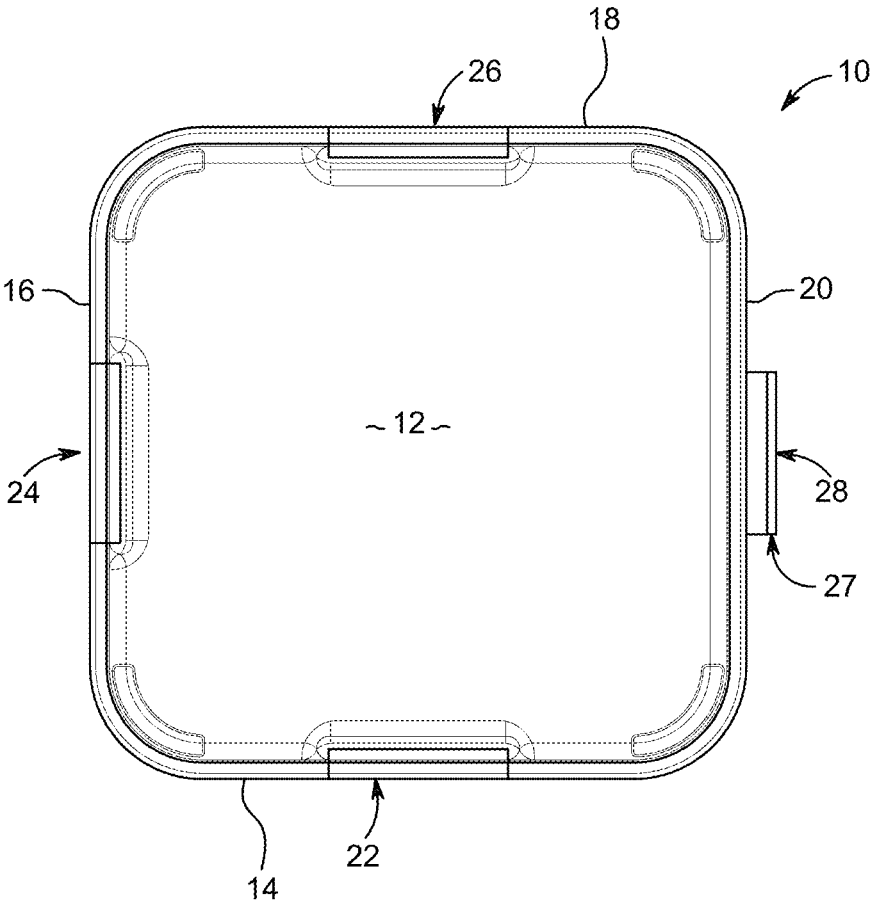
Figure 4:
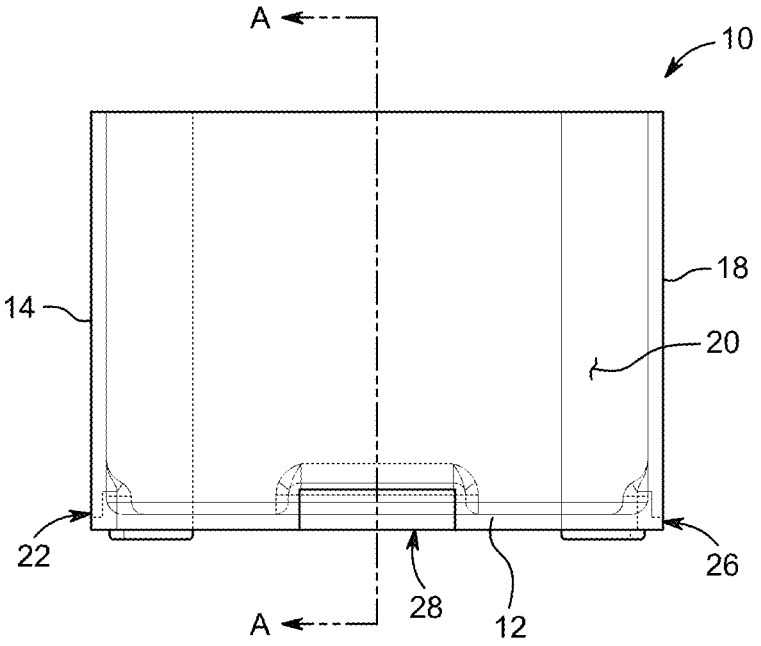

FIG. 3 is a top plan view of a first exemplary bin 10 according to the present invention. The male connector 28 of the exemplary embodiment is shown protruding from the fourth side wall 20 at the base 12, whereas the female connectors 22, 24, and 26, are disposed within the perimeter of the bin 10 on the other three sides. In the exemplary embodiment, the male connector 28 and female connectors 22, 24, and 26 are centered on the side of the bin 10. However, the connectors can be positioned at any point along a side wall of the bin 10 so long as they are positioned consistently for male connectors to connect to the female connectors. The position along the side affects the alignment of the adjacent bins 10 when the bins 10 are connected.

Figure 5:
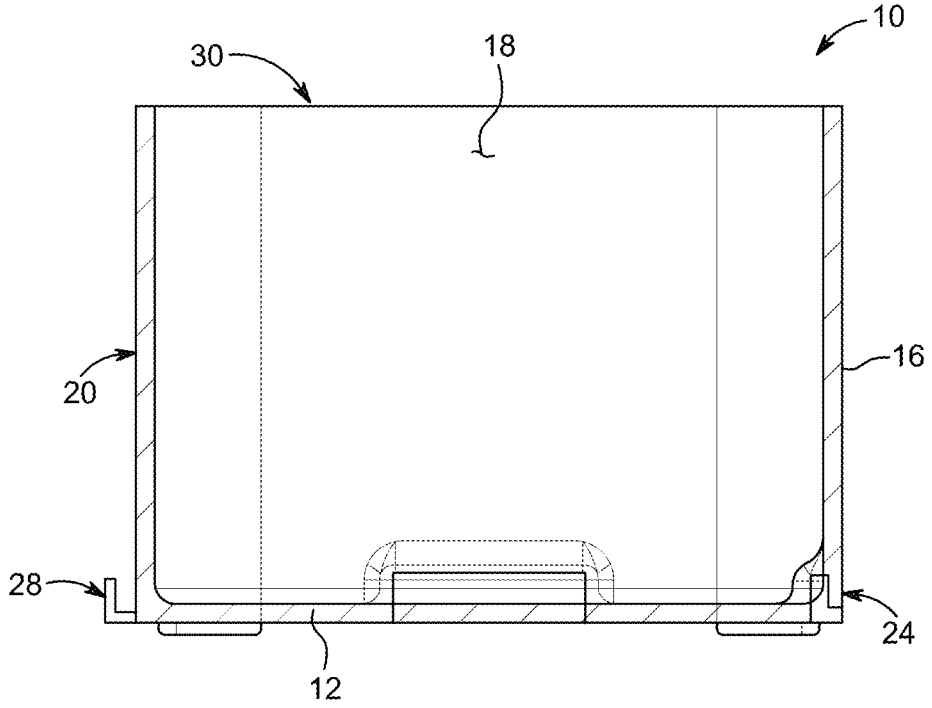
Figure 6:
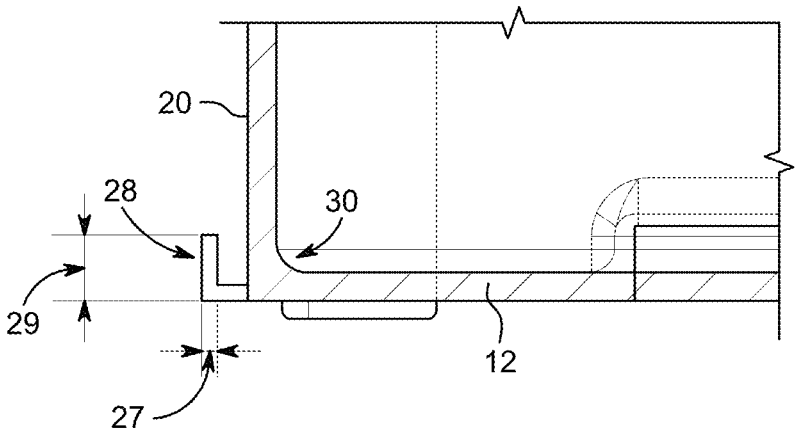
FIG. 6 shows a portion of FIG. 5 focusing on the exemplary male connector in the lower left-hand portion of FIG. 5.
Figure 8:
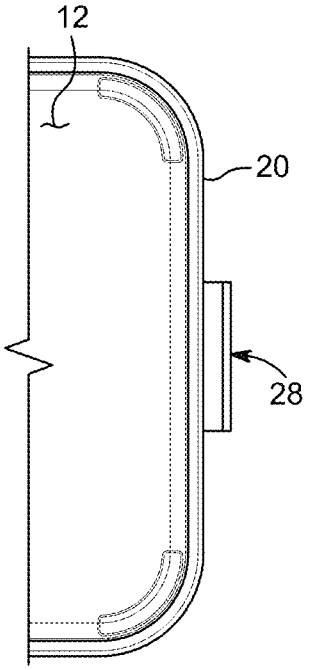
FIG. 8 shows a portion of FIG. 3 focusing on the exemplary male connector on the right side of FIG. 3.

Referring now to FIG. 6, this figure shows a portion of FIG. 5 focusing on the exemplary male connector 28 in the lower left-hand portion of FIG. 5. The exemplary male connector 28 is essentially an L-shaped flange that extends proximate the bottom 12 of the bin 10 extending from the corner 30 formed by the respective sidewall 20 and the bottom 12. FIG. 8 shows a portion of FIG. 3 focusing on the exemplary male connector 28 on the right side of FIG. 3. In exemplary embodiments, the male connector has the dimensions shown in the figures. Other configurations can be used that use the benefits of the present application.

Figure 7:
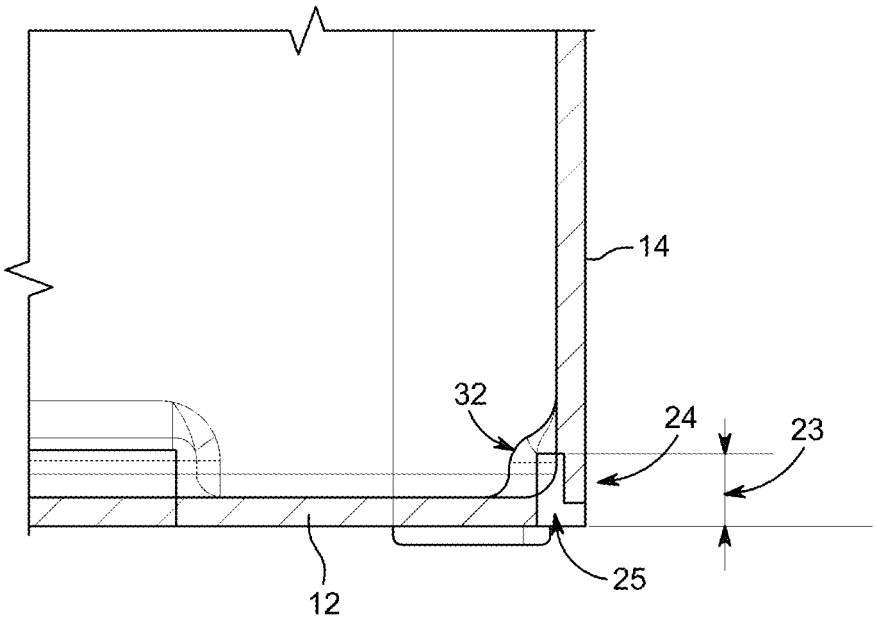
FIG. 7 shows a portion of FIG. 5 focusing on the exemplary female connector in the lower right-hand portion of FIG. 5.
Figure 9:
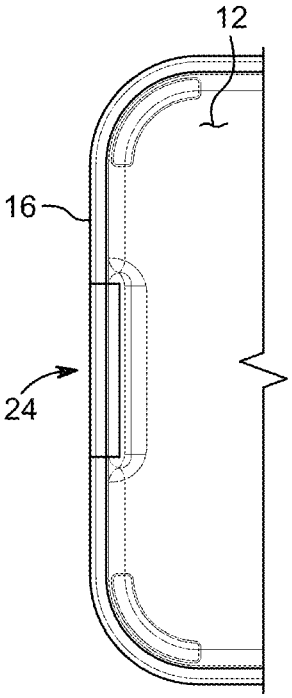
FIG. 9 shows a portion of FIG. 3 focusing on the exemplary female connector on the left side of FIG. 3.
Figure 10:
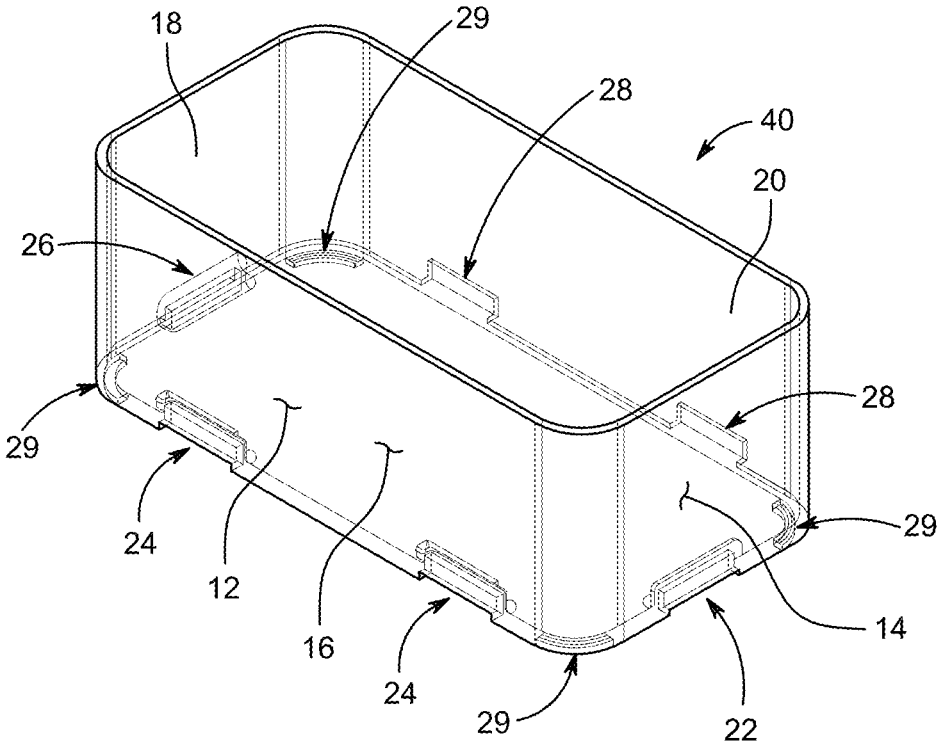
FIGS. 10-14 are various views of a second exemplary bin according to the present application, i.e., a front/right/top perspective view (FIG. 10), a front elevational view (FIG. 11), a top plan view (FIG. 12), a right side sectional view (FIG. 13) taken along section line A-A of FIG. 12, a front sectional view (FIG. 14) taken along section line B-B of FIG. 13, respectively.
Figure 11:
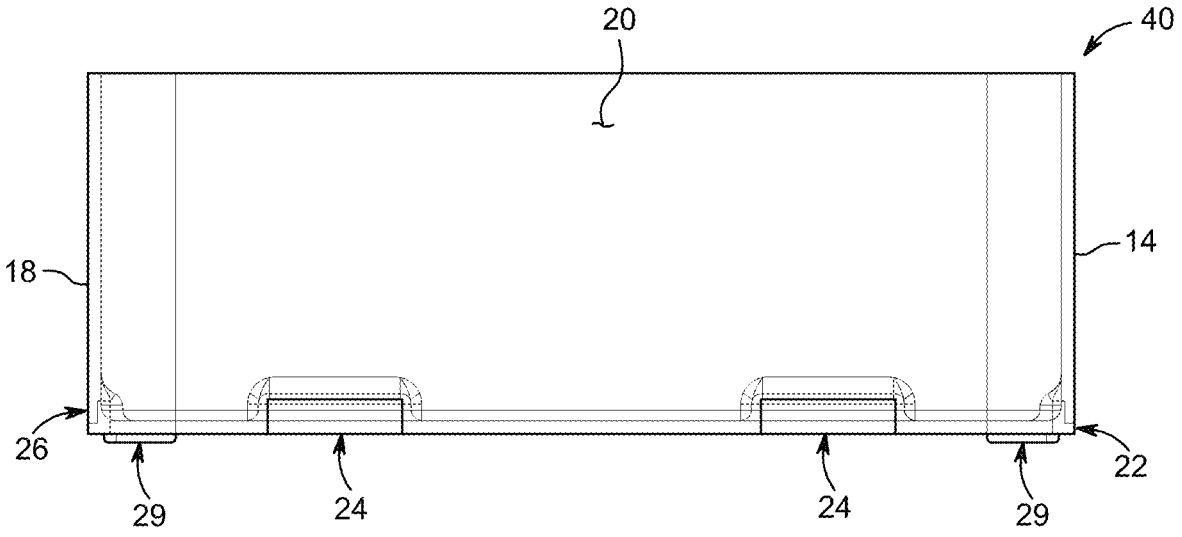
Figure 12:
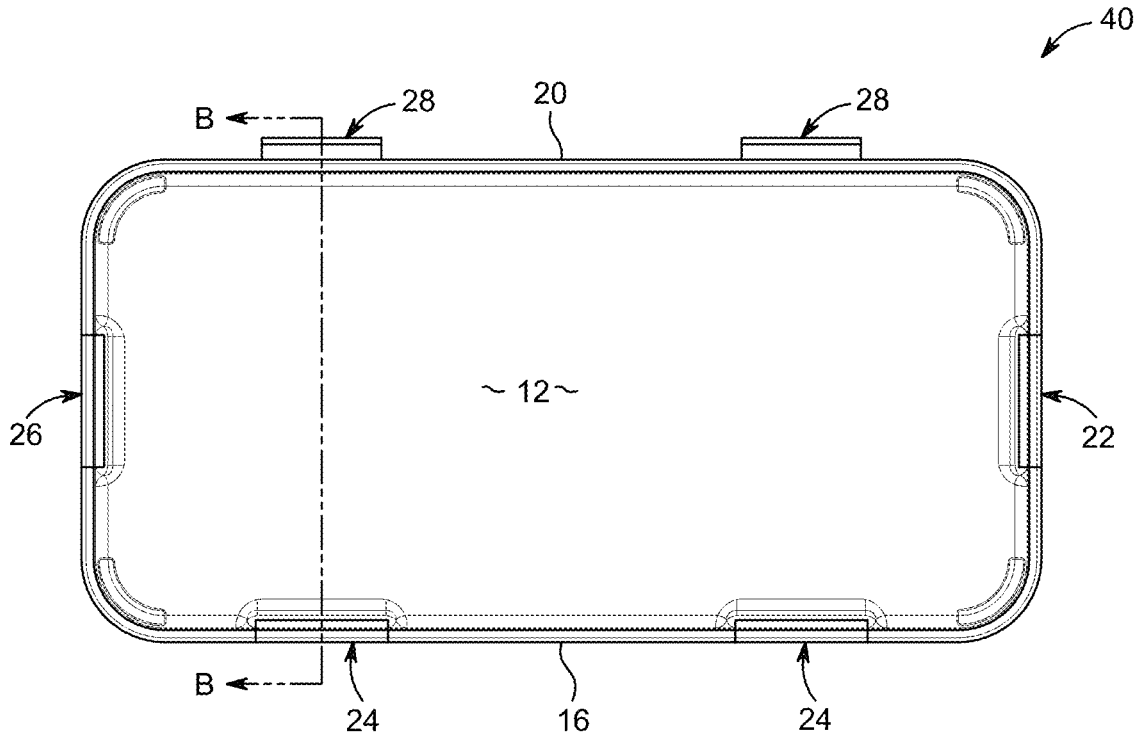
Figure 13:
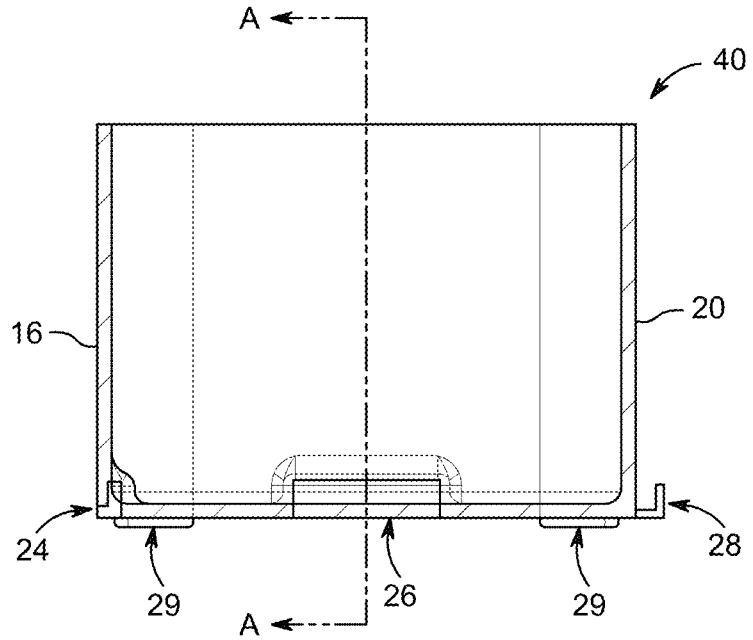
Figure 14:
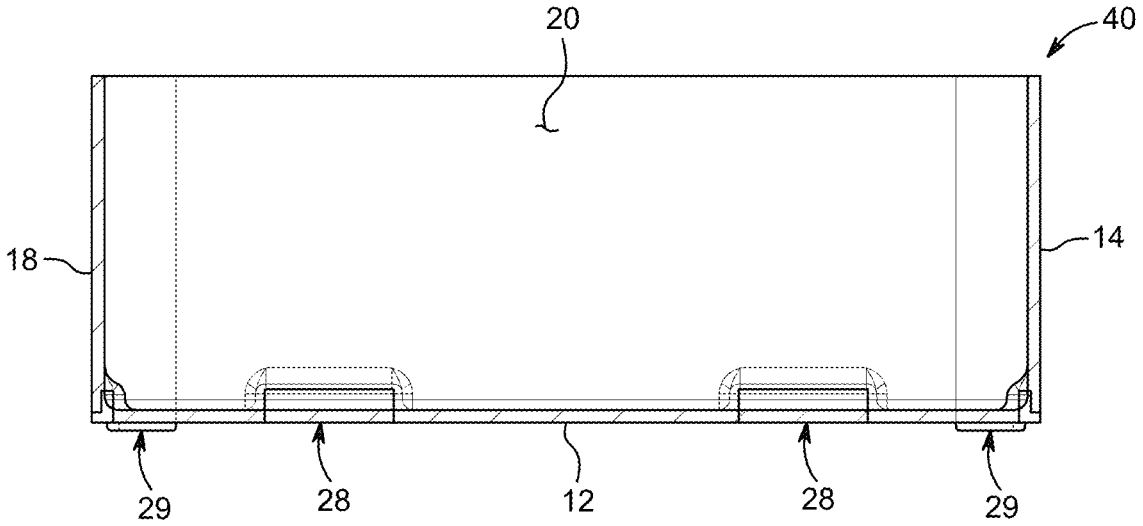

Referring now to FIG. 7, this figure shows a portion of FIG. 5 focusing on the exemplary female connector 24 in the lower right-hand portion of FIG. 5. FIG. 9 shows a portion of FIG. 3 focusing on the exemplary female connector 24 on the left side of FIG. 3. The exemplary female connector 24 is essentially an L-shaped depression in the bottom 12 of the bin 10 in the corner 32 formed by the respective sidewalls 14 and the bottom 12 to receive the male connector 28 to prevent relative motion of the connected bins. This configuration provides for female connector 24 sidewalls that are smooth and have no projections extending past the sidewall 14 surfaces.

The opening 25 of the female connector 24 must be at least the same as or greater than the width 27 of the male connector 28 to allow a connection. In the exemplary embodiment, the opening 25 of the female connector 24 is 0.09 inches and the width 27 of the male connector 28 is 0.05 inches. The larger the difference between the opening 25 and the width 27 allows for a looser connection with more flexibility and, conversely, the closer the opening 25 is in size to the width 27, the more rigid the connection. In addition, the height 29 of the male connector 28 and the height 23 of the female connector 24 also affect the rigidity of the connection. For example, in the exemplary embodiment the height 29 of the male connector 28 is 0.24 inches and the height 23 of the female connector 24 is 0.26 inches. As these heights, 23 and 29, are increased, the strength of the connection increases and, conversely, as these heights, 23 and 29, decrease, the strength of the connection decreases. Eventually, the heights will become relatively too short and the connection would not hold the bins 10 together. As the size of the bins 10 change, the height requirements would correspondingly change as well. Finally, the height 23 of the female connector 24 would ideally be a small amount taller than the height 29 of the male connector 28.

Figure 65:
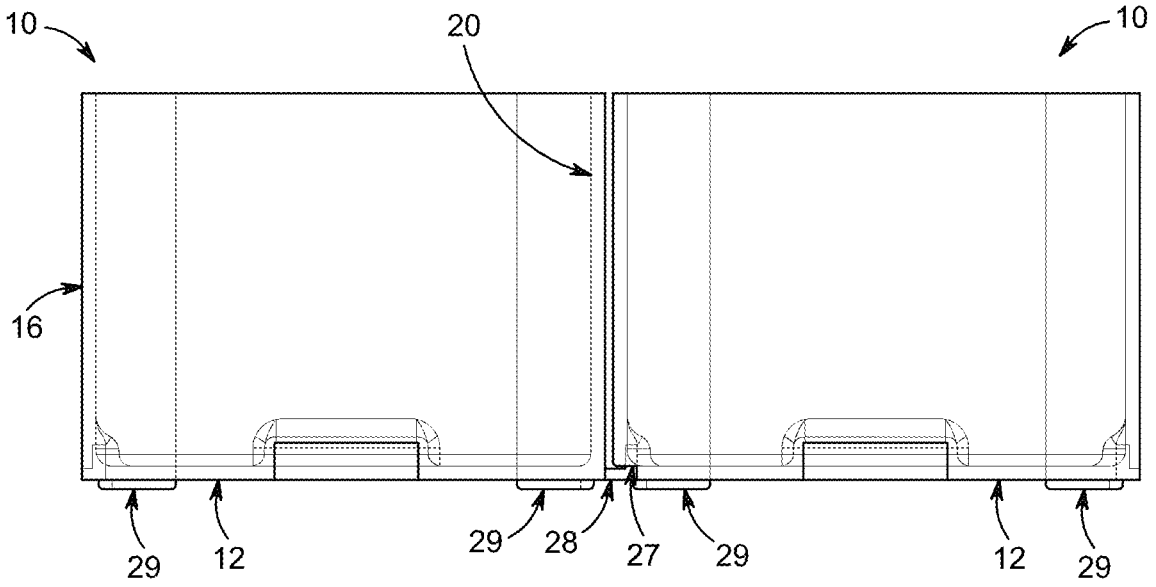
FIG. 65 is a side elevational view showing two bins of the first type connected side-by-side.

FIG. 65 is a side elevational view showing two bins 10 of the first type connected side-by-side with the male connector 28 inside one of the female connectors 22, 24, 26 and with gravity acting upon the mass of the right bin to generate a downward force to hold the male connector 28 inside the female connector to prevent lateral movement of the bins.

The exemplary bin 10 (and the other bins herein) can be molded from plastic, such as PET, e.g., clear PET, or PP, e.g., white PP.

FIGS. 10-14 are various views of a second exemplary bin 40 according to the present application. The second exemplary bin 40 is virtually identical to the first exemplary bin 10 except two of the side walls are longer and there are two male connectors on one of the longer sidewalls and two female connectors on the other of the longer sidewalls. Like exemplary bin 10, exemplary bin 40 is capable of connecting to other bins to prevent relative lateral movement and comprises a base 12 (in this case the bottom of the bin) having first, second, third, and fourth sides and a first wall 14, a second wall 16, a third wall 18, and a fourth wall 20 extending up from first, second, and third sides of the base 12. In this exemplary four-sided embodiment of FIGS. 10-14, one of the first side wall 14 and the base 12 on the first side has a first connector 22 of a first type, such as a female connector, one of the second side 16 and the base 12 on the second side has two second connectors 24 of the first type; one of the third side wall 18 and the base 12 on the third side has a third connector 26 of the first type; and one of the fourth wall 20 and the base on its fourth side has two connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 40 are the same as bin 10 (e.g. shown in FIGS. 6, 8) and the female connectors of bin 40 are the same as bin 10 (e.g. shown in FIGS. 7, 9). In some exemplary embodiments, it is helpful to have the side walls of some bins be an integer multiplier of the length of the sidewalls of other bins. For example, the longer sidewalls of bin 40 in exemplary embodiments are about twice as long as the sidewalls of bin 10. This allows one bin 40 connect to two bins 10 to form a square.

Figure 15:
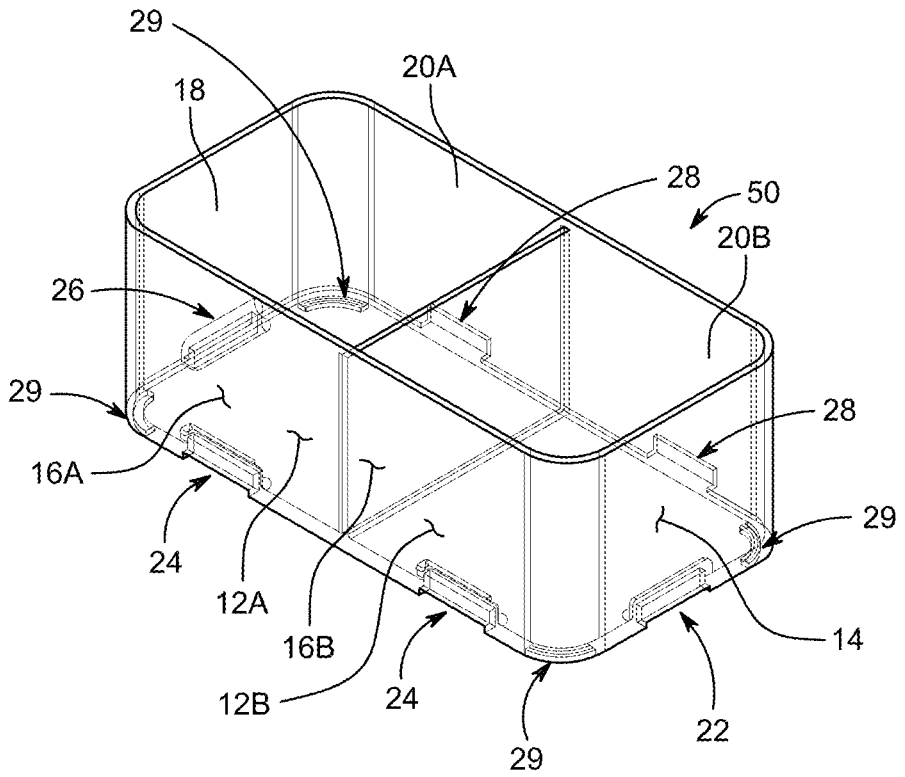
FIGS. 15-16 are views of a third exemplary bin according to the present application, i.e., a front/right/top perspective view (FIG. 15) and a front elevational view (FIG. 16), respectively.
Figure 16:
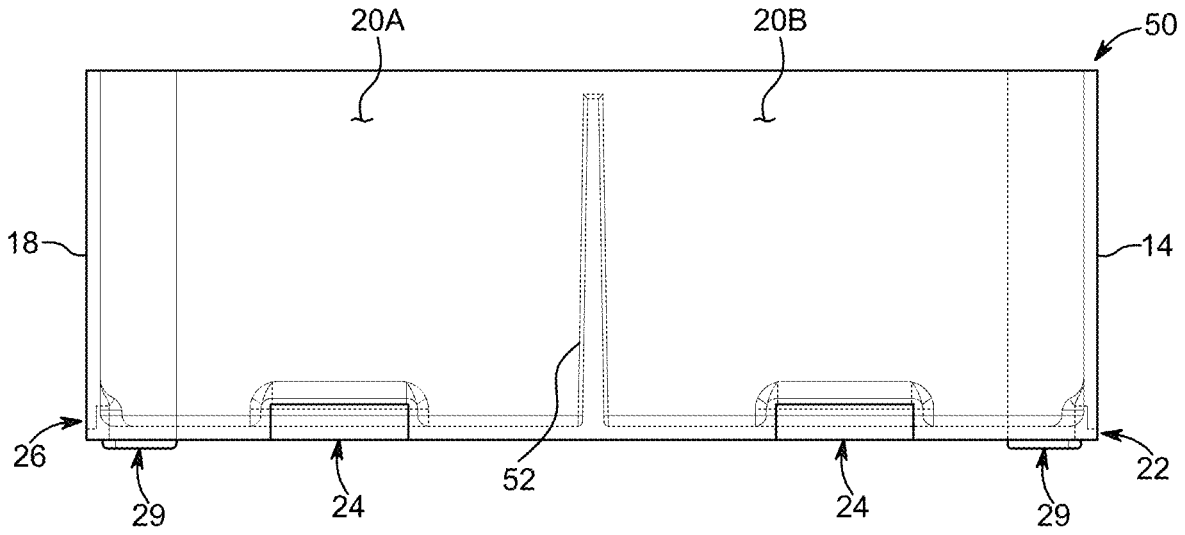

FIGS. 15-16 are various views of a third exemplary bin 50 according to the present application. The third exemplary bin 50 is virtually identical to the second exemplary bin 40 except there is a divider 52 that separates a second wall into second wall 16A and second wall 16B along with fourth wall 20A and fourth wall 20B. Like exemplary bin 10, exemplary bin 50 is capable of connecting to other bins to prevent relative lateral movement and comprises a base 12 (in this case the bottom of the bin) having first, second, third, and fourth sides and a first wall 14, a second wall 16A and 16B, a third wall 18, and a fourth wall 20A and 20B extending up from first, second, and third sides of the base 12. In this exemplary four-sided embodiment of FIGS. 15-16, one of the first side wall 14 and the base 12 on the first side has a first connector 22 of a first type, such as a female connector, one of the second side 16 and the base 12 on the second side has two second connectors 24 of the first type; one of the third side wall 18 and the base 12 on the third side has a third connector 26 of the first type; and one of the fourth wall 20 and the base on its fourth side has two connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 50 are the same as bin 10 (e.g. shown in FIGS. 6, 8) and the female connectors of bin 50 are the same as bin 10 (e.g. shown in FIGS. 7, 9). In some exemplary embodiments, it is helpful to have the side walls of some bins be an integer multiplier of the length of the sidewalls of other bins. For example, the longer sidewalls of bin 50 in exemplary embodiments are about twice as long as the sidewalls of bin 10. This allows one bin 50 connect to two bins 10 to form a square.

Figure 17:
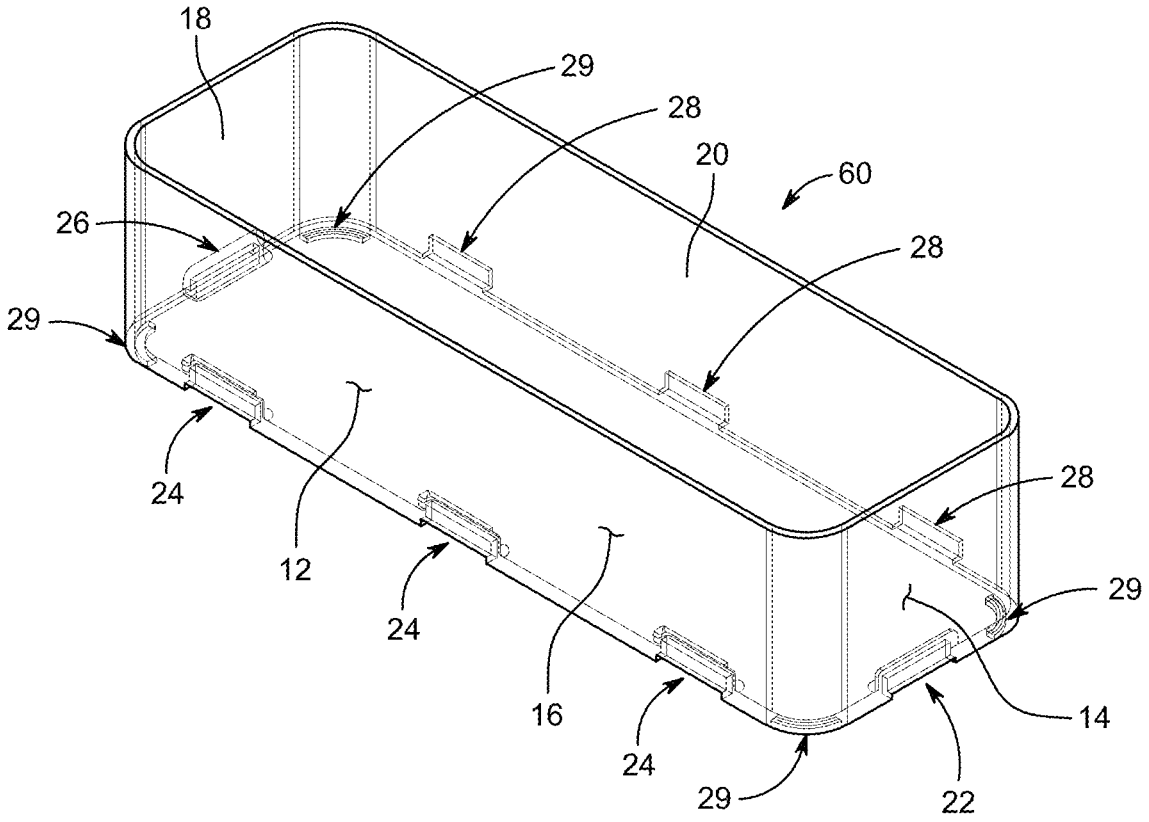
FIGS. 17-18 are views of a fourth exemplary bin according to the present application, i.e., a front/right/top perspective view (FIG. 17) and a top plan view (FIG. 18), respectively.
Figure 18:
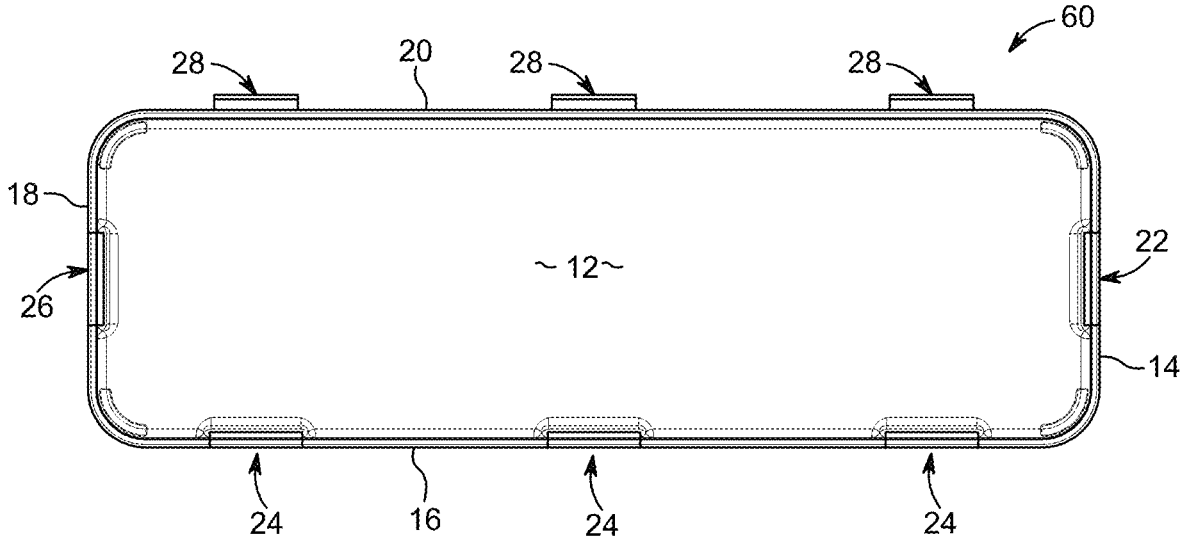

FIGS. 17-18 are views of a fourth exemplary bin 60 according to the present application. The fourth exemplary bin 60 is virtually identical to the first exemplary bin 10 except two of the side walls are longer and there are three male connectors on one of the longer sidewalls and three female connectors on the other of the longer sidewalls. Like exemplary bin 10, exemplary bin 60 is capable of connecting to other bins to prevent relative lateral movement and comprises a base 12 (in this case the bottom of the bin) having first, second, third, and fourth sides and a first wall 14, a second wall 16, a third wall 18, and a fourth wall 20 extending up from first, second, and third sides of the base 12. In this exemplary four-sided embodiment of FIGS. 17-18, one of the first side wall 14 and the base 12 on the first side has a first connector 22 of a first type, such as a female connector, one of the second side 16 and the base 12 on the second side has three second connectors 24 of the first type; one of the third side wall 18 and the base 12 on the third side has a third connector 26 of the first type; and one of the fourth wall 20 and the base on its fourth side has three connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 60 are the same as bin 10 (e.g. shown in FIGS. 6, 8) and the female connectors of bin 60 are the same as bin 10 (e.g. shown in FIGS. 7, 9). In some exemplary embodiments, it is helpful to have the side walls of some bins be an integer multiplier of the length of the sidewalls of other bins. For example, the longer sidewalls of bin 60 in exemplary embodiments are about three times as long as the sidewalls of bin 10. This allows one bin 60 connect to two more bins 60 to form a square.

Figure 19:
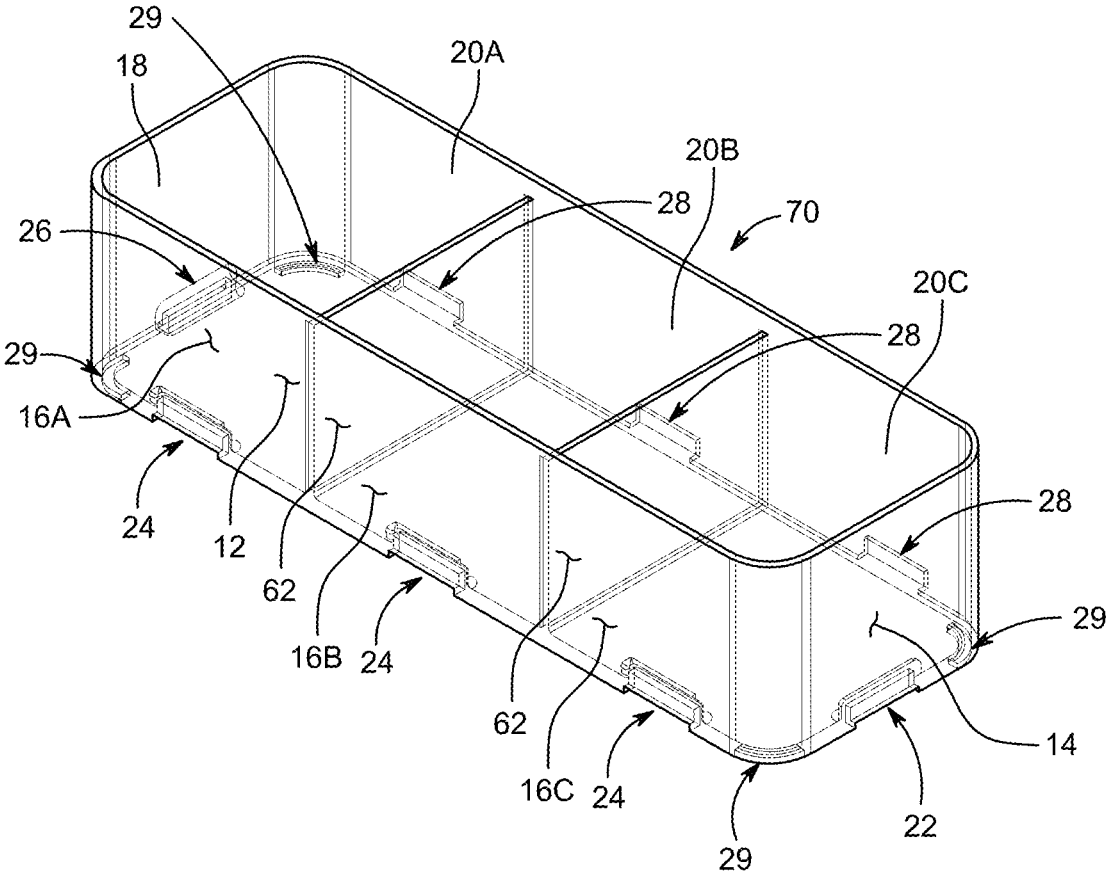
FIGS. 19-20 are views of a fifth exemplary bin according to the present application, i.e., a front/right/top perspective view (FIG. 19) and a top plan view (FIG. 20), respectively.
Figure 20:
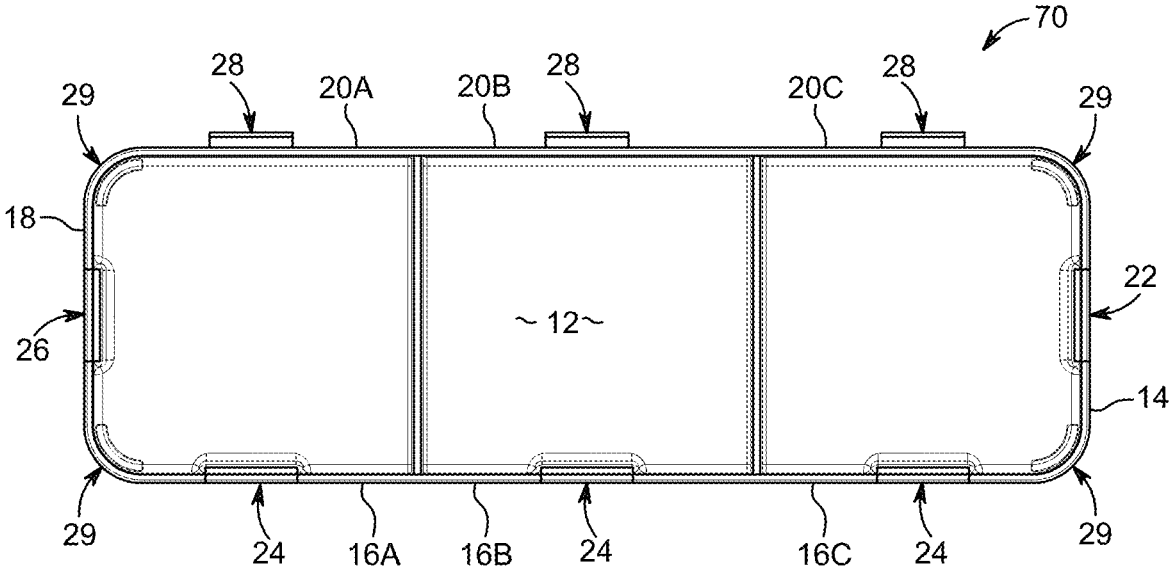

FIGS. 19-20 are views of a fifth exemplary bin 70 according to the present application. The fifth exemplary bin 70 is virtually identical to the fourth exemplary bin 60 except there are two dividers 62 that separate a second wall into second wall 16A, second wall 16B, and second wall 16C, along with fourth wall 20A, fourth wall 20B, and fourth wall 20C. Like exemplary bin 10, exemplary bin 70 is capable of connecting to other bins to prevent relative lateral movement and comprises a base 12 (in this case the bottom of the bin) having first, second, third, and fourth sides and a first wall 14, a second wall 16A, 16B, and 16C, a third wall 18, and a fourth wall 20A, 20B, and 20C extending up from first, second, and third sides of the base 12. In this exemplary four-sided embodiment of FIGS. 19-20, one of the first side wall 14 and the base 12 on the first side has a first connector 22 of a first type, such as a female connector, one of the second side 16 and the base 12 on the second side has three second connectors 24 of the first type; one of the third side wall 18 and the base 12 on the third side has a third connector 26 of the first type; and one of the fourth wall 20 and the base on its fourth side has three connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 70 are the same as bin 10 (e.g. shown in FIGS. 6, 8) and the female connectors of bin 70 are the same as bin 10 (e.g. shown in FIGS. 7, 9). In some exemplary embodiments, it is helpful to have the side walls of some bins be an integer multiplier of the length of the sidewalls of other bins. For example, the longer sidewalls of bin 70 in exemplary embodiments are about three as long as the sidewalls of bin 10. This allows one bin 70 connect to two more bins 70 to form a square.

Figure 21:
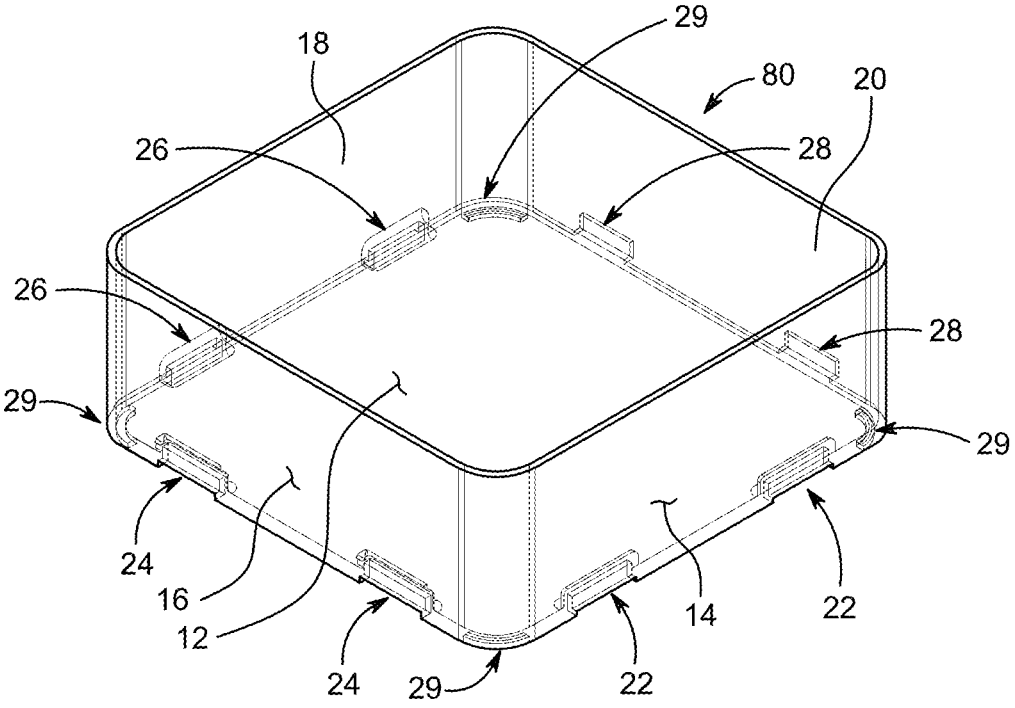
FIGS. 21-22 are views of a sixth exemplary bin according to the present application, i.e., a front/right/top perspective view (FIG. 21) and a top plan view (FIG. 22), respectively.
Figure 22:
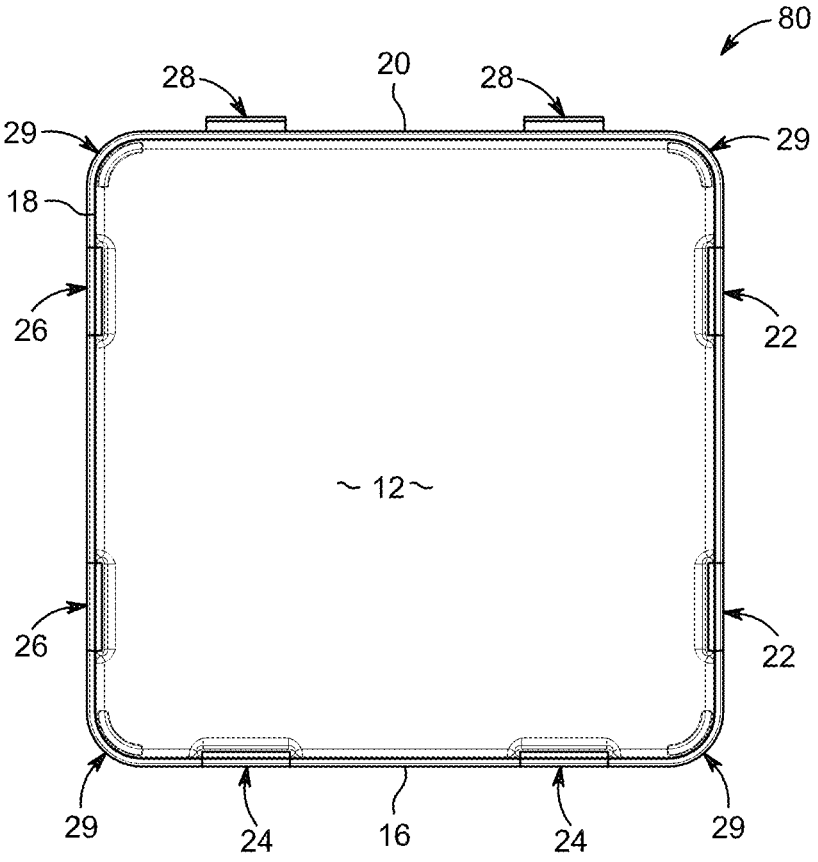

FIGS. 21-22 are views of a sixth exemplary bin according to the present application. The sixth exemplary bin 80 is virtually identical to the first exemplary bin 10 except there are two male connectors on one of the sidewalls and two female connectors on the other sidewalls. Like exemplary bin 10, exemplary bin 80 is capable of connecting to other bins to prevent relative lateral movement and comprises a base 12 (in this case the bottom of the bin) having first, second, third, and fourth sides and a first wall 14, a second wall 16, a third wall 18, and a fourth wall 20 extending up from first, second, and third sides of the base 12. In this exemplary four-sided embodiment of FIGS. 21-22, one of the first side wall 14 and the base 12 on the first side has two connectors 22 of a first type, such as a female connector, one of the second side 16 and the base 12 on the second side has two second connectors 24 of the first type; one of the third side wall 18 and the base 12 on the third side has two third connectors 26 of the first type; and one of the fourth wall 20 and the base on its fourth side has two connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 80 are the same as bin 10 (e.g. shown in FIGS. 6, 8) and the female connectors of bin 80 are the same as bin 10 (e.g. shown in FIGS. 7, 9).

Figure 23:
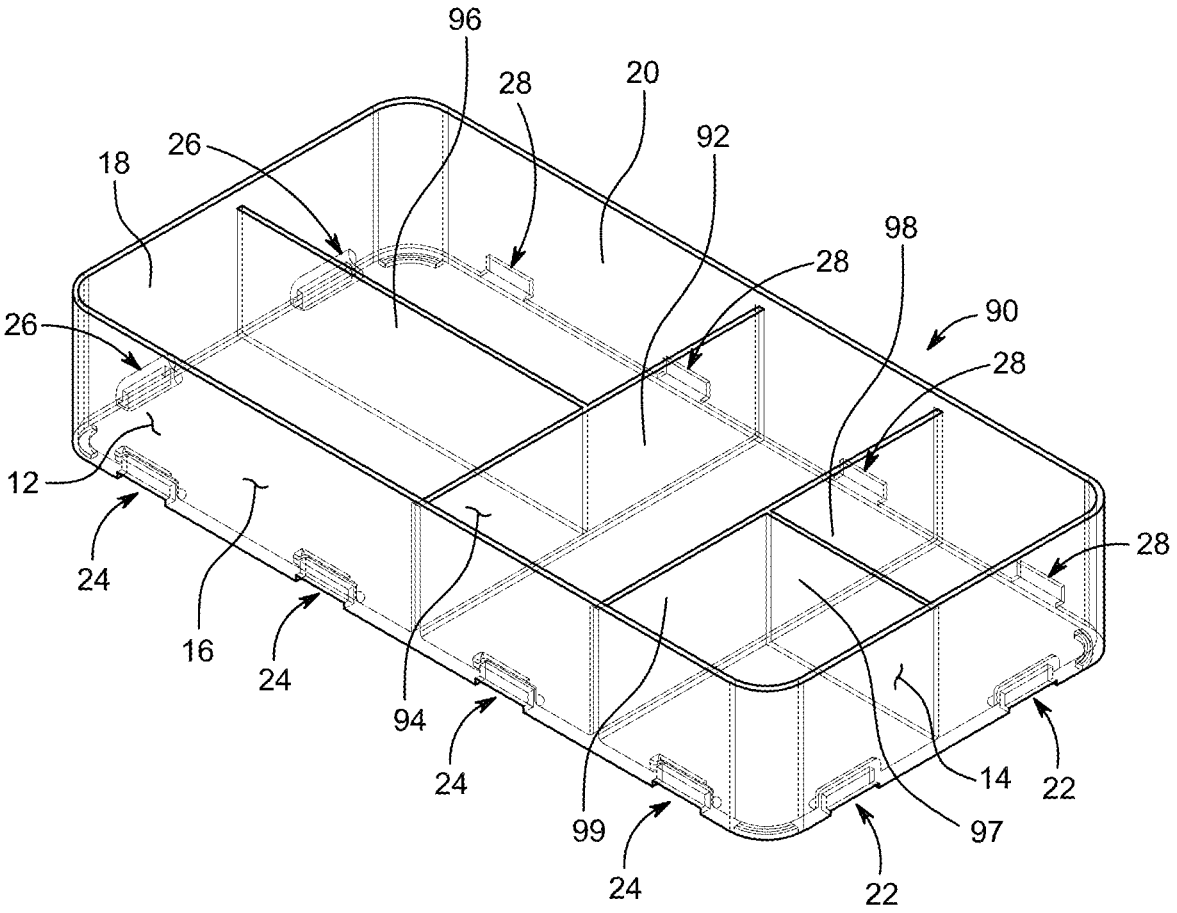
FIGS. 23-25 are various views of a seventh exemplary bin according to the present application, i.e., a front/right/top perspective view (FIG. 23), a front elevational view (FIG. 24), and a top plan view (FIG. 25), respectively.
Figure 24:
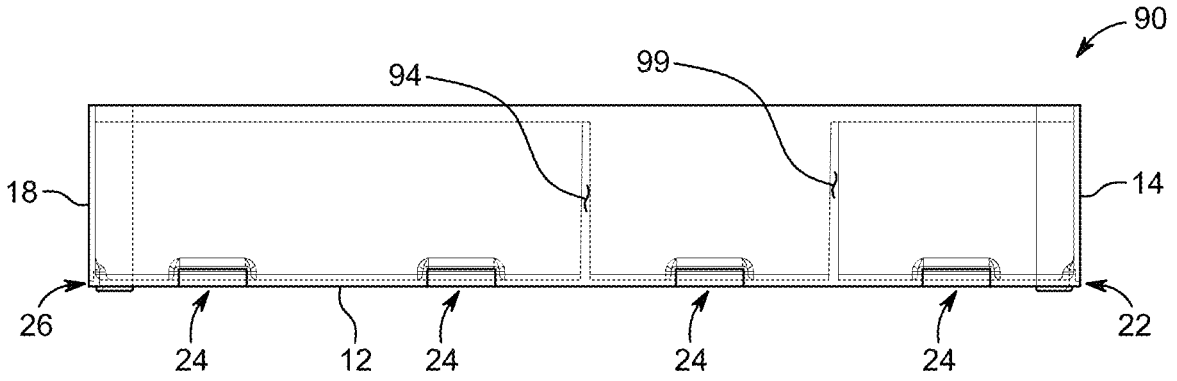
Figure 25:
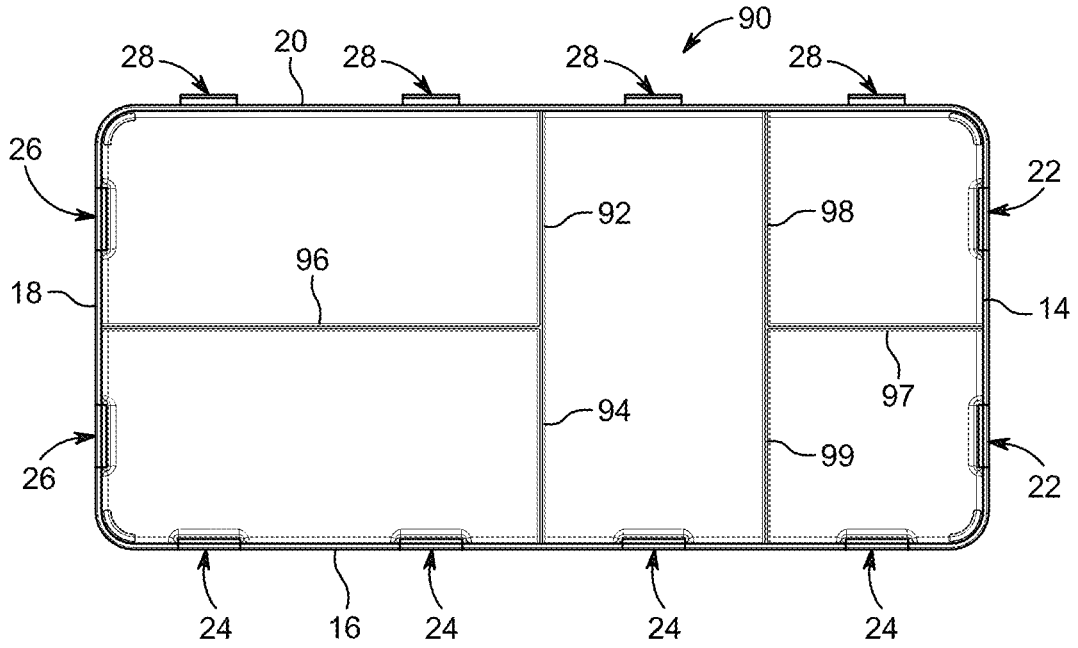

FIGS. 23-25 are various views of a seventh exemplary bin according to the present application. The seventh exemplary bin 90 is virtually identical to the fifth exemplary bin 70 except there is a first divider 96 that connects to a second divider 92 and a third divider 94 that separate a second wall 16, a fourth wall 20 and a third wall 18. There is also a fourth divider 97, a fifth divider 98 and a sixth divider 99 that similarly separate the second wall 16, the fourth wall 20, and the first wall 14. Like exemplary bin 10, exemplary bin 90 is capable of connecting to other bins to prevent relative lateral movement and comprises a base 12 (in this case the bottom of the bin) having first, second, third, and fourth sides and a first wall 14, a second wall 16, a third wall 18, and a fourth wall 20 extending up from first, second, and third sides of the base 12. In this exemplary four-sided embodiment of FIGS. 23-25, one of the first side wall 14 and the base 12 on the first side has two first connectors 22 of a first type, such as a female connector, one of the second side 16 and the base 12 on the second side has four connectors 24 of the first type; one of the third side wall 18 and the base 12 on the third side has two third connectors 26 of the first type; and one of the fourth wall 20 and the base on its fourth side has four connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 90 are the same as bin 10 (e.g. shown in FIGS. 6, 8) and the female connectors of bin 90 are the same as bin 10 (e.g. shown in FIGS. 7, 9). In some exemplary embodiments, it is helpful to have the side walls of some bins be an integer multiplier of the length of the sidewalls of other bins. For example, the longer sidewalls of bin 90 in exemplary embodiments are about four times as long as the sidewalls of bin 10 and the shorter sidewalls of bin 90 in exemplary embodiments are bout two times as long as the sidewalls of bin 10.

Figure 26:
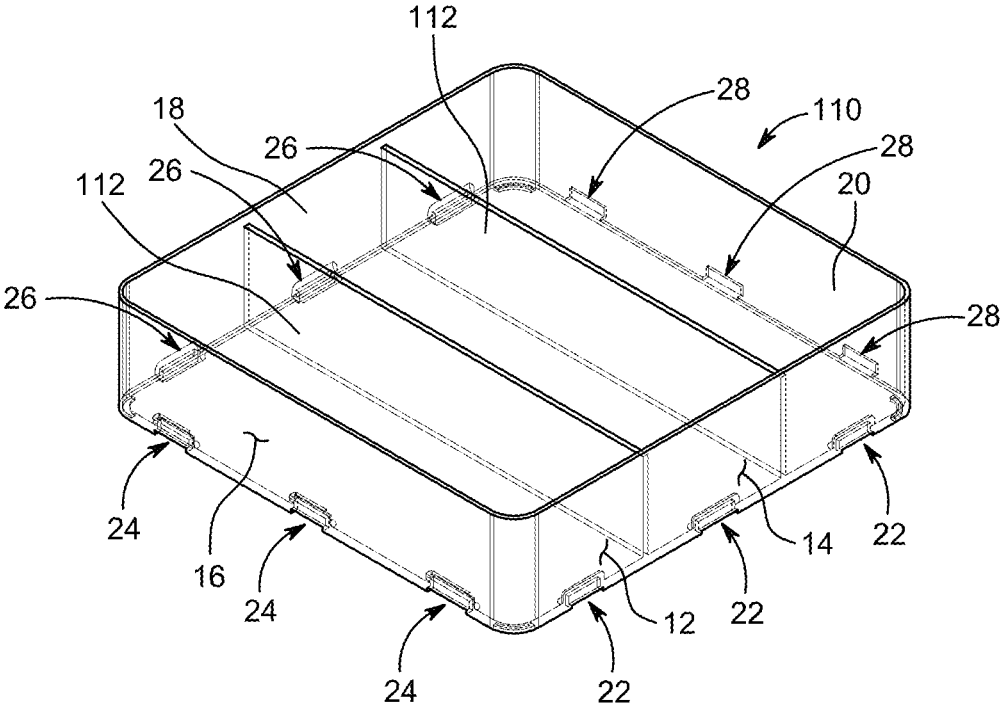
FIGS. 26-27 are views of a eighth exemplary bin according to the present application, i.e., a front/right/top perspective view (FIG. 26) and a top plan view (FIG. 27), respectively.
Figure 27:
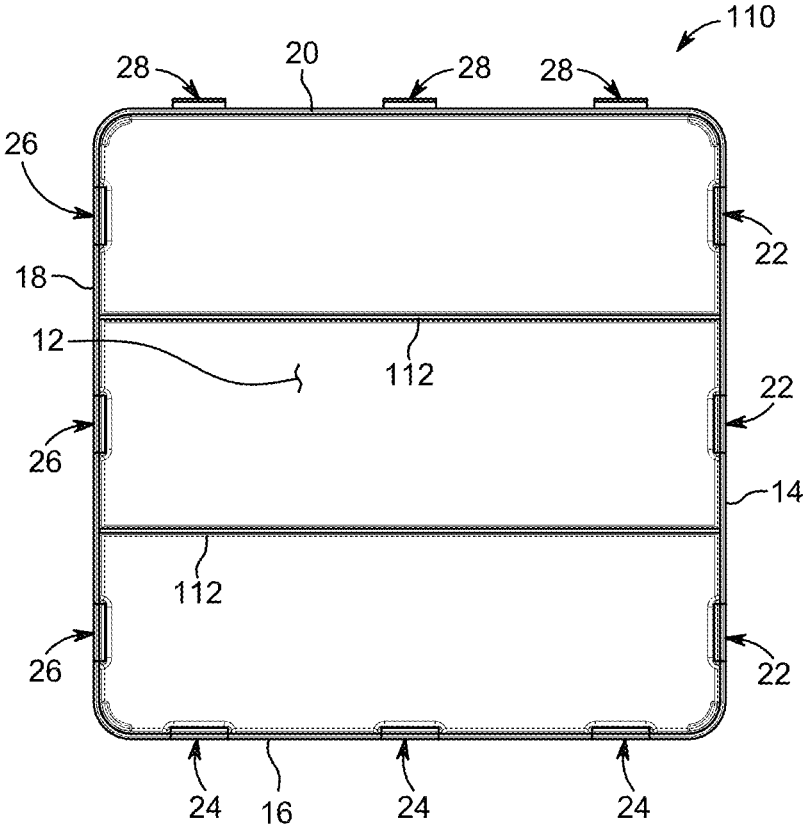

FIGS. 26-27 are views of a eighth exemplary bin according to the present application. The eighth exemplary bin 110 is virtually identical to the fifth exemplary bin 70 except there are two dividers 112 that separate third wall 18 and first wall 14 into three sections. Like exemplary bin 10, exemplary bin 110 is capable of connecting to other bins to prevent relative lateral movement and comprises a base 12 (in this case the bottom of the bin) having first, second, third, and fourth sides and a first wall 14, a second wall, a third wall 18, and a fourth wall 20 extending up from first, second, and third sides of the base 12. In this exemplary four-sided embodiment of FIGS. 26-27, one of the first side wall 14 and the base 12 on the first side has three first connectors 22 of a first type, such as a female connector, one of the second side 16 and the base 12 on the second side has three second connectors 24 of the first type; one of the third side wall 18 and the base 12 on the third side has three third connectors 26 of the first type; and one of the fourth wall 20 and the base on its fourth side has three connectors 28 of a second type, such as a male connector. Connectors of the first type 22, such as a female connector, connect to connectors of the second type 28, such as a male connector, to prevent relative lateral movement of connected bins. In some exemplary embodiments, the male connectors in bin 110 are the same as bin 10 (e.g. shown in FIGS. 6, 8) and the female connectors of bin 110 are the same as bin 10 (e.g. shown in FIGS. 7, 9). In some exemplary embodiments, one bin 110 can connect to three more bins 110 to form a square.

Figure 28:
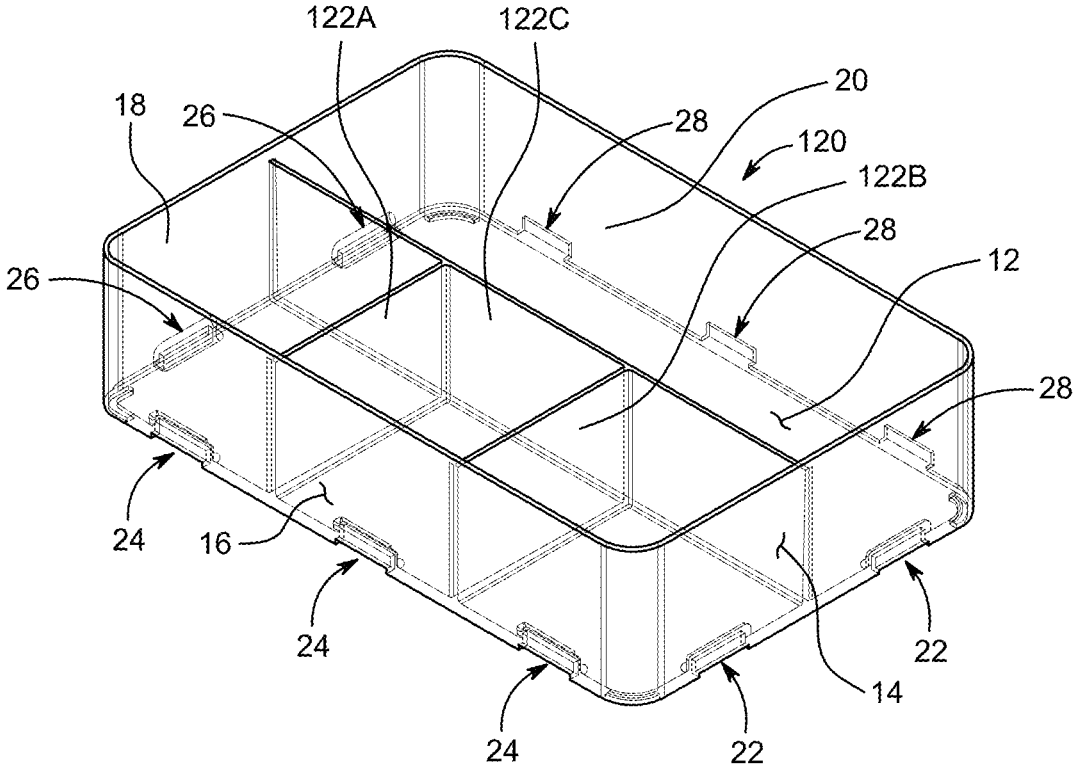
FIGS. 28-29 are views of a ninth exemplary bin according to the present application, i.e., a front/right/top perspective view (FIG. 28) and a top plan view (FIG. 29), respectively.
Figure 29:
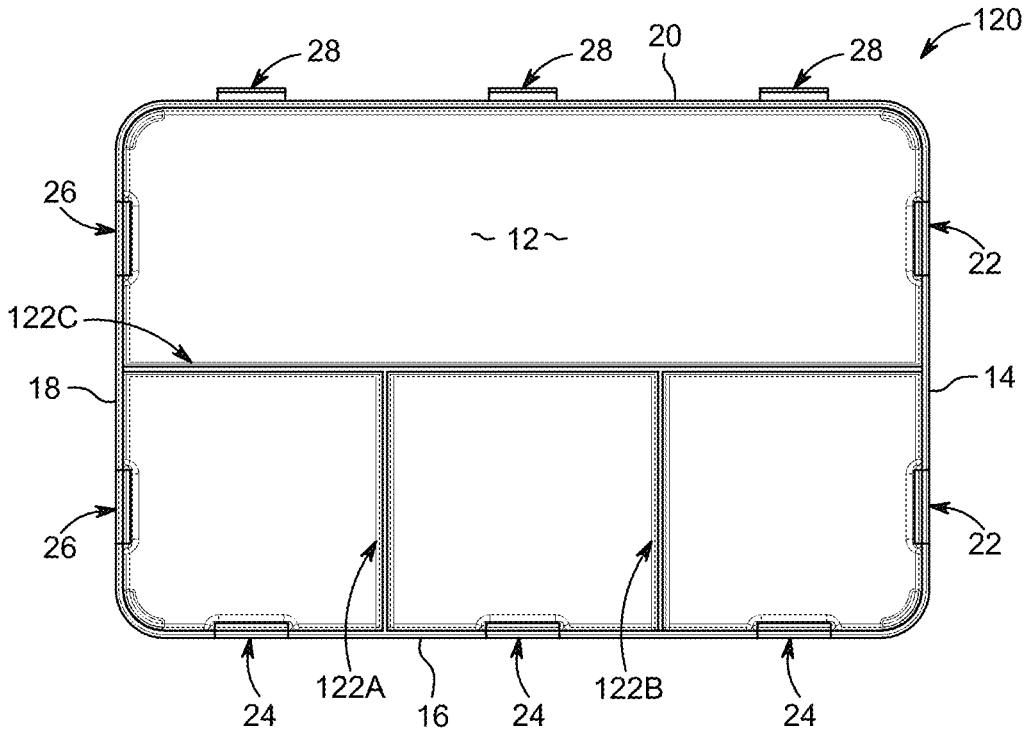

FIGS. 28-29 are views of a ninth exemplary bin according to the present application. The ninth exemplary bin 120 is virtually identical to the fifth exemplary bin 70 except there is a first divider 122C that separates third wall 18 and first wall 14. Additionally, there is a second divider 122A and a third divider 122B that connect to the first divider 122C and the second wall 16. Like exemplary bin 10, exemplary bin 120 is capable of connecting to other bins to prevent relative lateral movement and comprises a base 12 (in this case the bottom of the bin) having first, second, third, and fourth sides and a first wall 14, a second wall, a third wall 18, and a fourth wall 20 extending up from first, second, and third sides of the base 12. In this exemplary four-sided embodiment of FIGS. 28-29, one of the first side wall 14 and the base 12 on the first side has two first connectors 22 of a first type, such as a female connector, one of the second side 16 and the base 12 on the second side has three second connectors 24 of the first type; one of the third side wall 18 and the base 12 on the third side has two connectors 26 of the first type; and one of the fourth wall 20 and the base on its fourth side has three connectors 28 of a second type, such as a male connector. Connectors of the first type 22, such as a female connector, connect to connectors of the second type 28, such as a male connector, to prevent relative lateral movement of connected bins.

Figure 30:
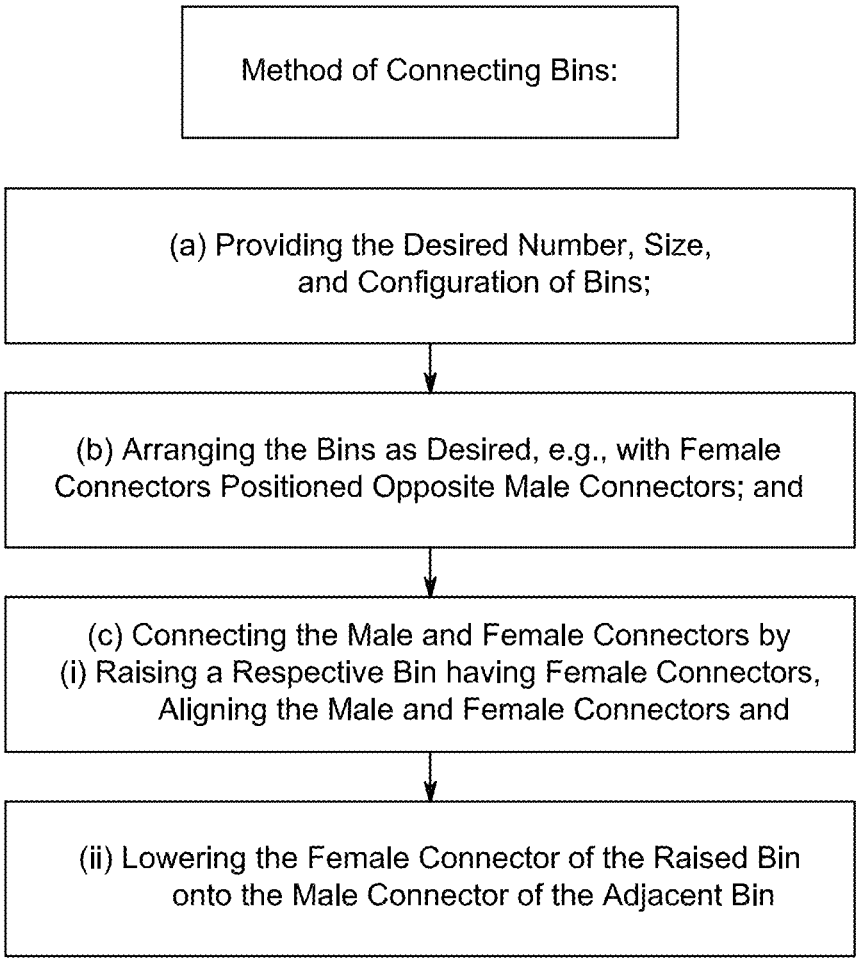
FIG. 30 is a flow chart showing an exemplary method.
Figure 31:
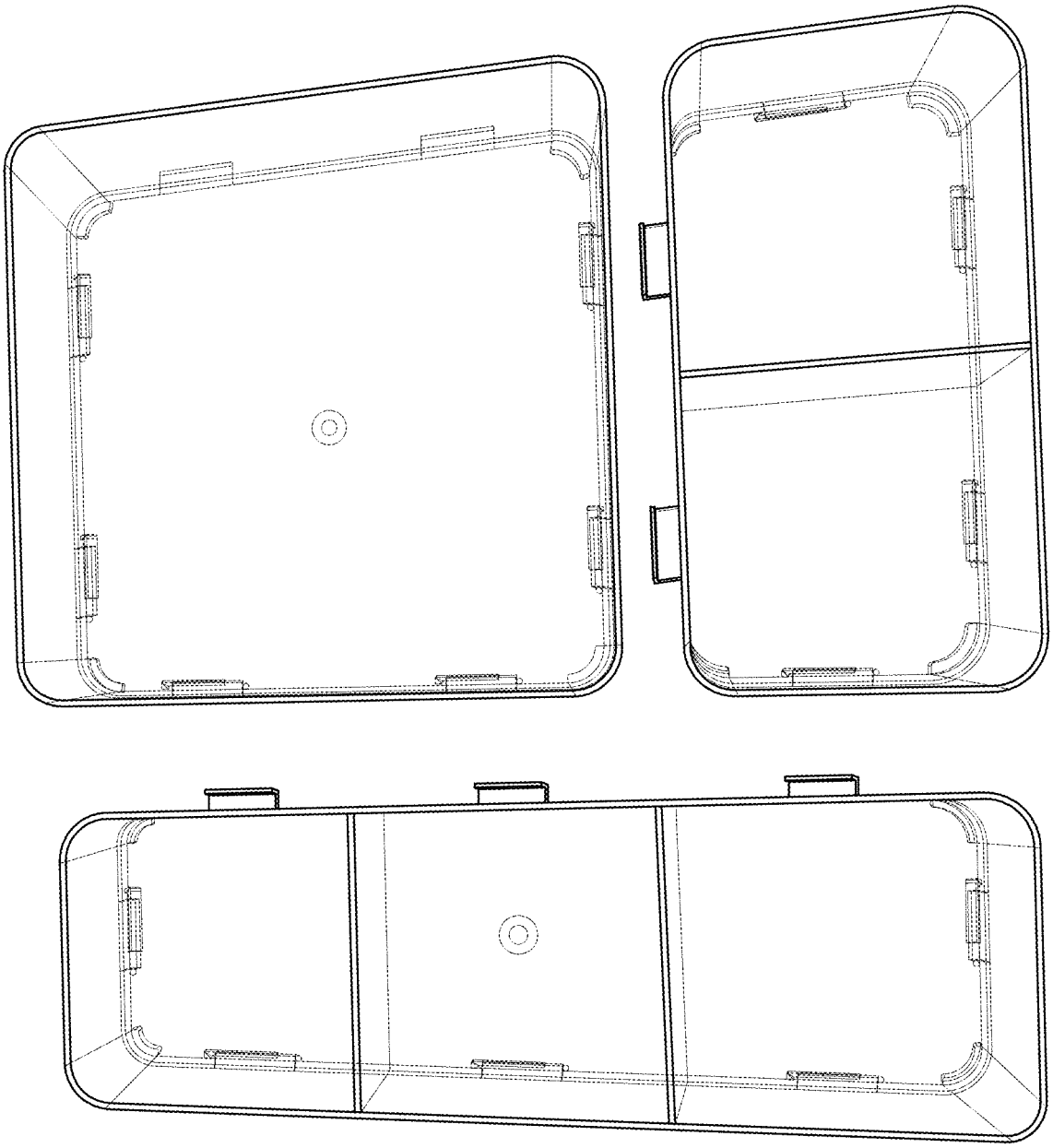
FIGS. 31-35 show arrangements of bins exemplifying the method of FIG. 30.
Figure 32:
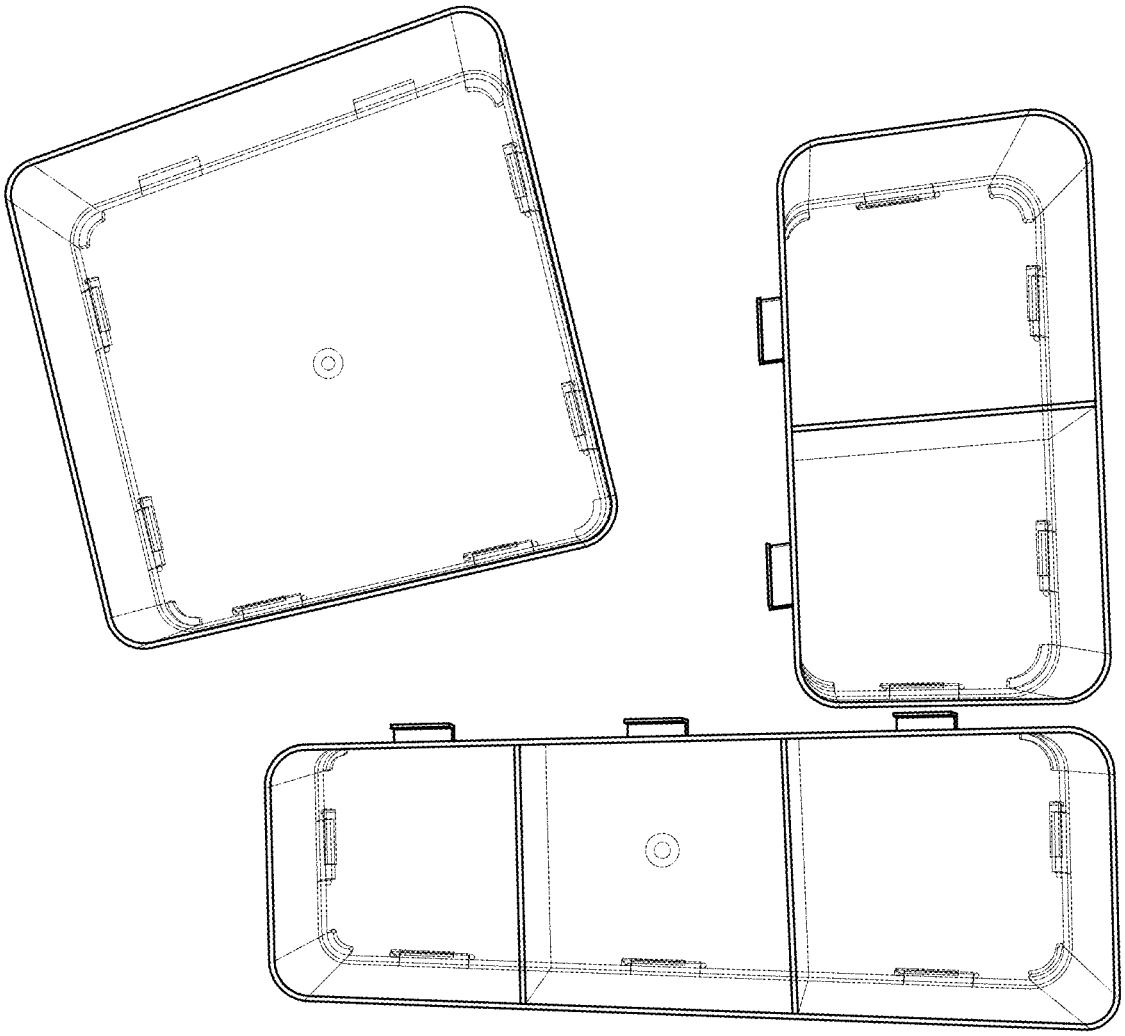
Figure 33:
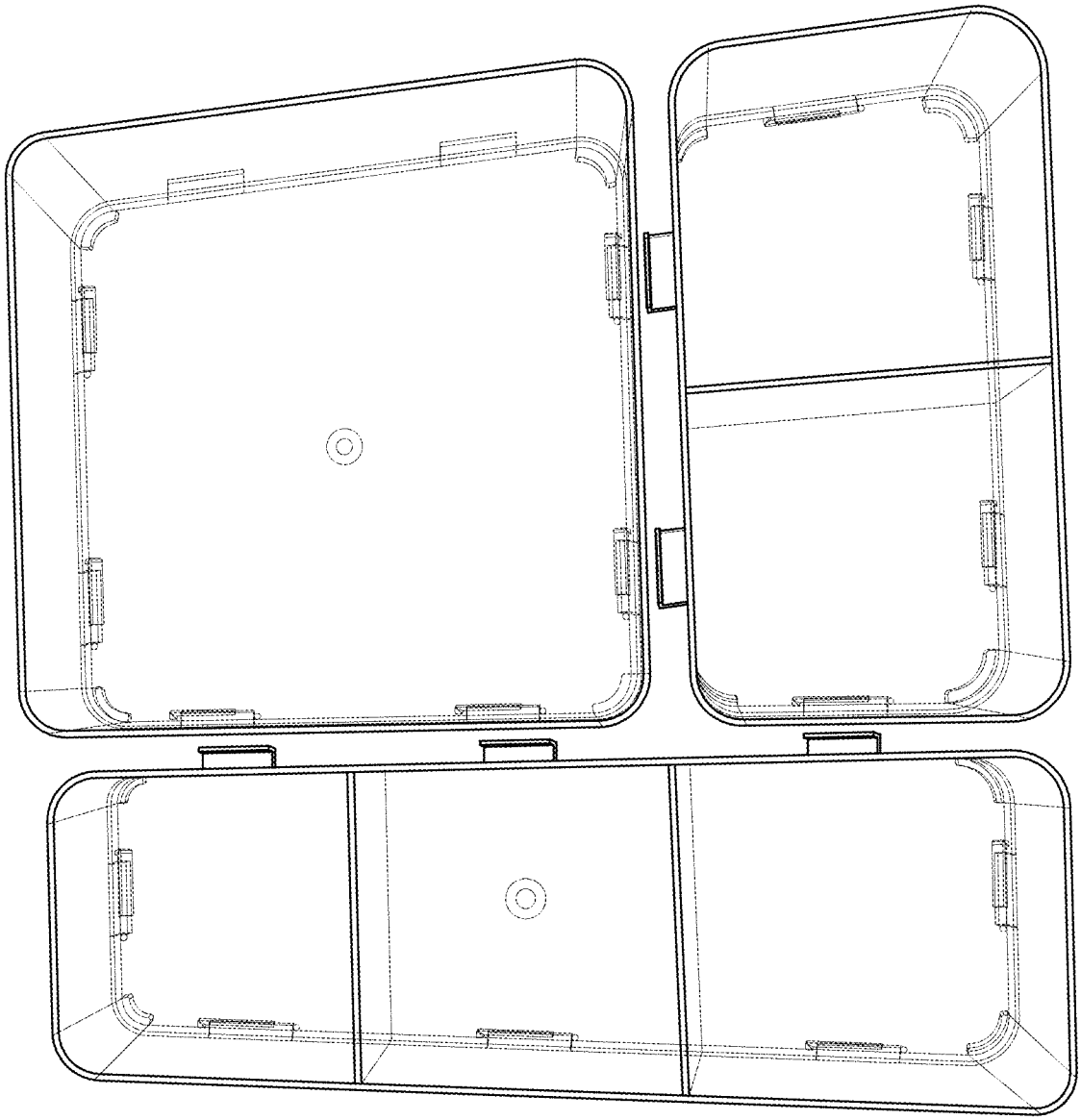
Figure 34:
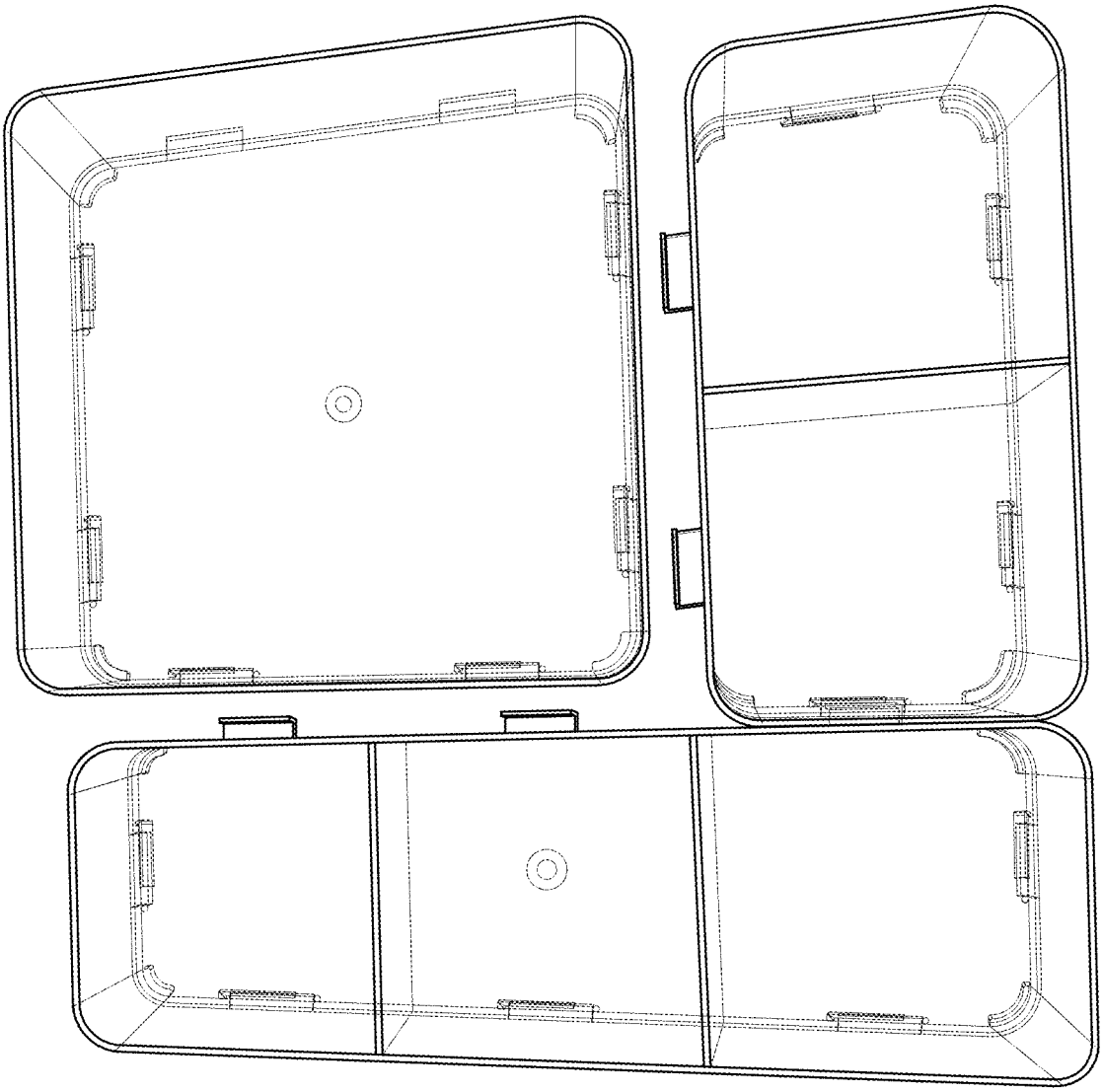
Figure 35:
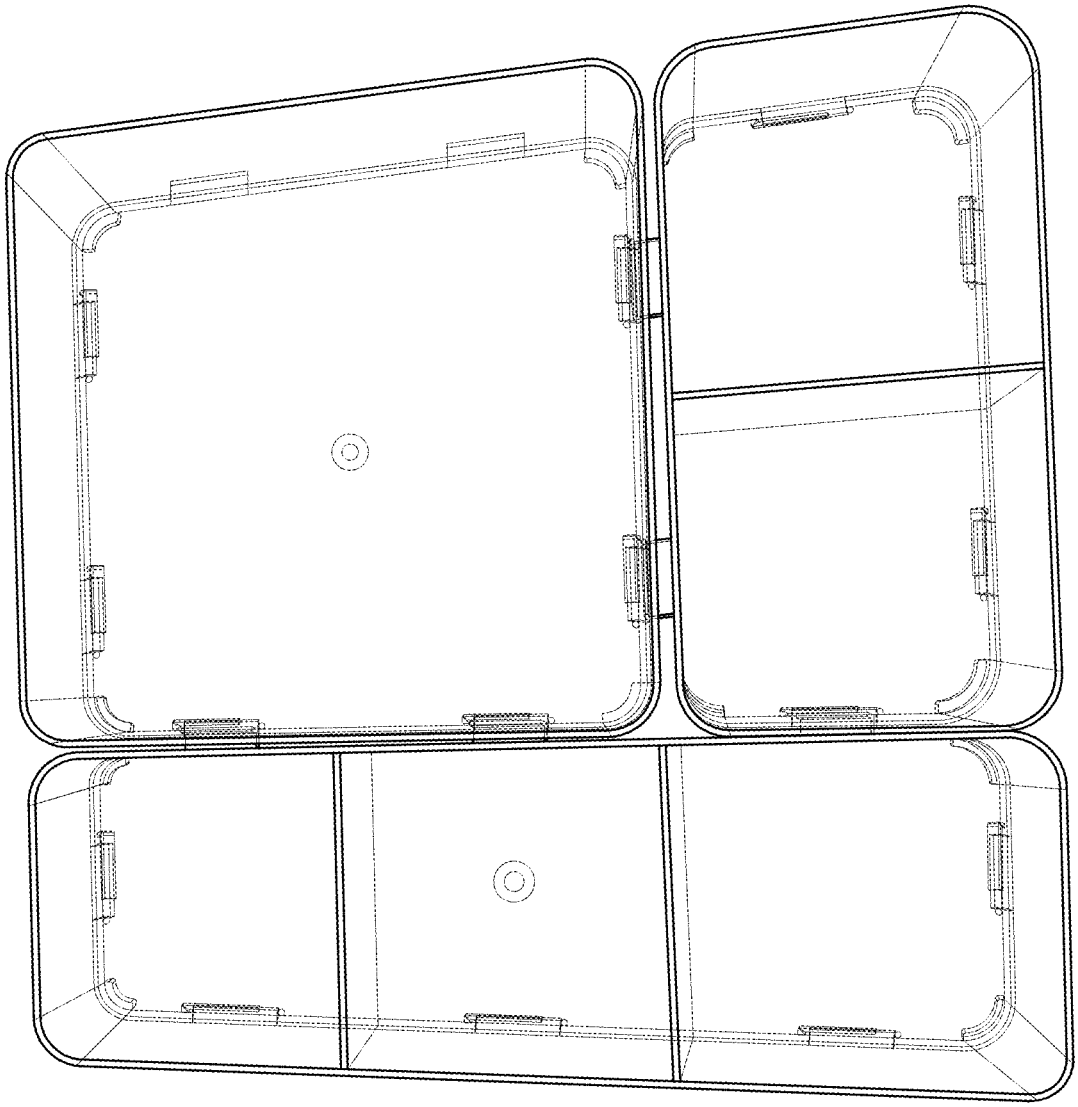
Figure 36:
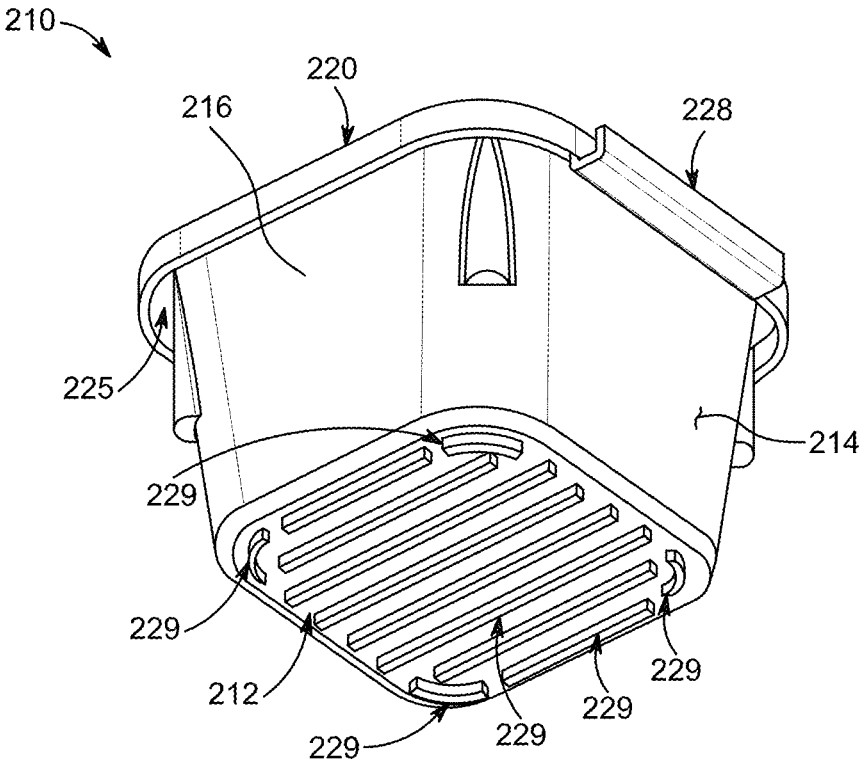
FIGS. 36-40 are various views of a tenth exemplary bin according to the present application, i.e., a front/left/bottom perspective view (FIG. 36), a rear/right/top perspective view (FIG. 37), a front elevational view (FIG. 38), a top plan view (FIG. 39), and a left side elevational view (FIG. 40) (a right side elevational view would be a mirror image thereof).
Figure 37:
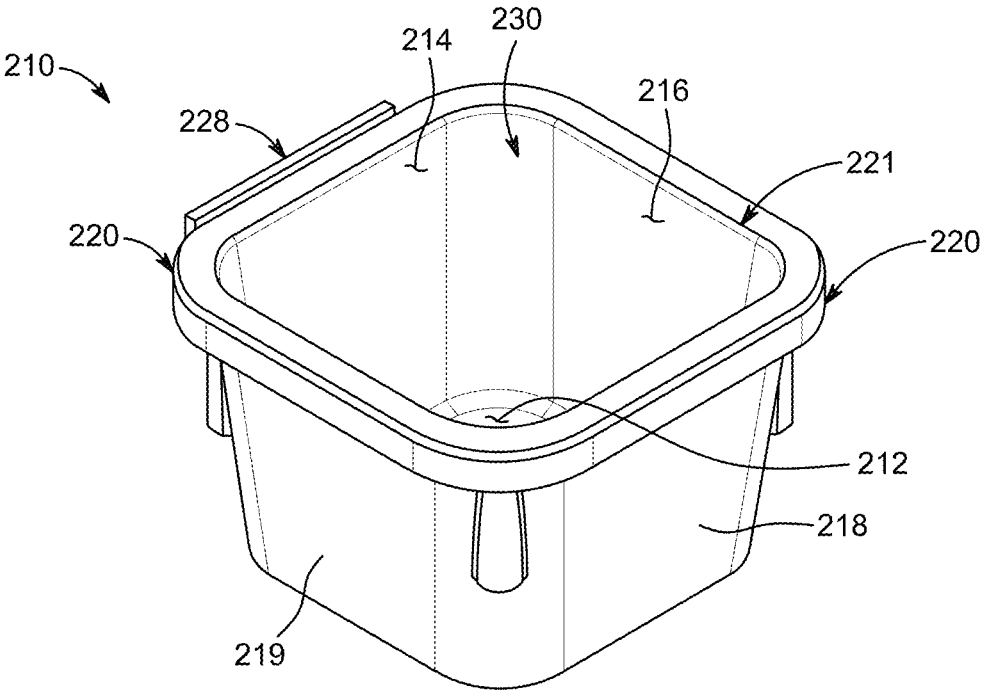

FIG. 30 is a flow chart showing an exemplary method of connecting bins according to the present application.

FIGS. 31-35 show arrangements of bins exemplifying the method of FIG. 30.

A second type of bin is shown in FIGS. 36-64. In exemplary embodiments, bins of the second type in FIGS. 36-64 are shown with the female connector 220 in the form of an L-flange extending around the entire upper perimeter of the bins with one of the male connectors 228 extending from the distal end of one of the female connectors 220. Other configurations are possible.

Referring now to FIGS. 36-41, a top side connecting exemplary bin 210 capable of connecting to other bins to prevent relative lateral movement comprises: a base 212 (in this case the bottom of the bin) having at least first, second, and third sides and at least a first wall 214, a second wall 216, and a third wall 218 extending up from first, second, and third sides of the base 212. Optionally, if the bin is a four-sided bin, the base 212 has a fourth side and the bin 210 would have a fourth wall 219. In exemplary embodiments, a continuous female connector 220 is on at least three sides and a male connector 228 is on one side connected to the female connector 220. Other exemplary four-sided bins could possibly have a male connectors 228 on more than one side. Some exemplary embodiments are three-sided bins with a continuous female connector and one or more male connectors. In the exemplary four-sided embodiment of FIGS. 36-41, the continuous female connector 220 is connected to the top 221 on all four sides and a male connector 228 of a second type is on the first side 214 connected to the female connector 220. Connectors of the first type 220, such as a female connector 220, connect to connectors of the second type 228, such as a male connector 228, to prevent relative lateral movement of connected bins. Optionally, the bin 210 can include feet 229. In the current embodiment, the feet 229 are in the corners of the bin 210, run along the base 212 of the bin 210 and extend around the perimeter along the base 212 of the bin 210. However, the feet 229, could be smaller or larger than pictured and could be continuous around the perimeter. Exemplary bins have an open top, exemplified by opening 230.

Figure 38:
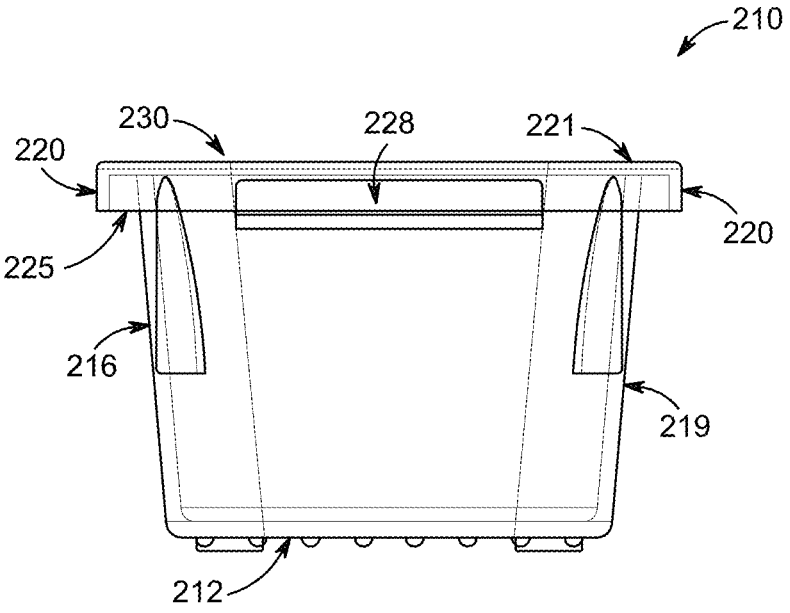

FIG. 38 is a front elevational view of the first exemplary bin 210 according to the present application. The female connectors 220 of certain exemplary embodiments are shown at the left and right facing the reader and the male connector 228 of certain embodiments is shown in the center connected to a female connector 220. Other configurations of male connectors 228 and female connectors 220 can be used. The bin 210 could be used to store items that could be placed inside the bin 210 via the opening 230. In some exemplary embodiments, the exemplary male connector 228 is an L-shaped flange that extends proximate to the female connector 220 of the bin 210, extending outward horizontally and upwards vertically.

Figure 39:
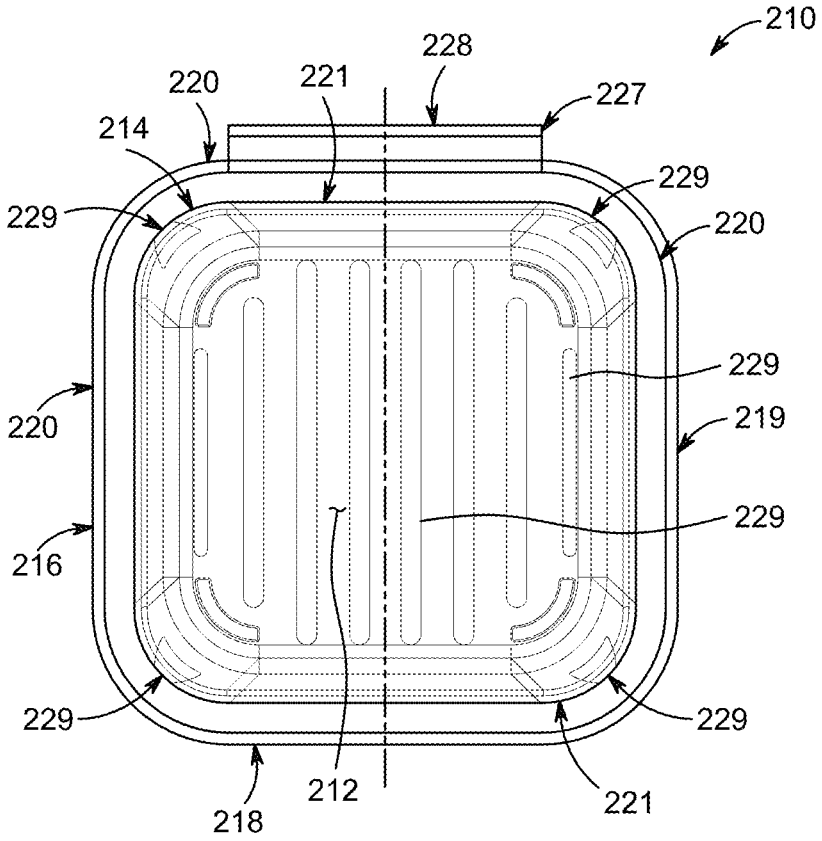

FIG. 39 is a top plan view of a first exemplary bin 210 according to the present invention. The male connector 228 of the exemplary embodiment is shown protruding from the first side wall 214 connected to the female connector 220, whereas the female connector 220 is connected to the top 221 of the first side wall 214, the top 221 of the second side wall 216, the top 221 of the third side wall 218 and the top 221 of the fourth side wall 219. In the exemplary embodiment, the male connector 228 is centered on a side of the bin 210. However, the male connector 228 can be positioned at any point along a side wall and the respective female connector 220 of the bin 210.

Figure 40:
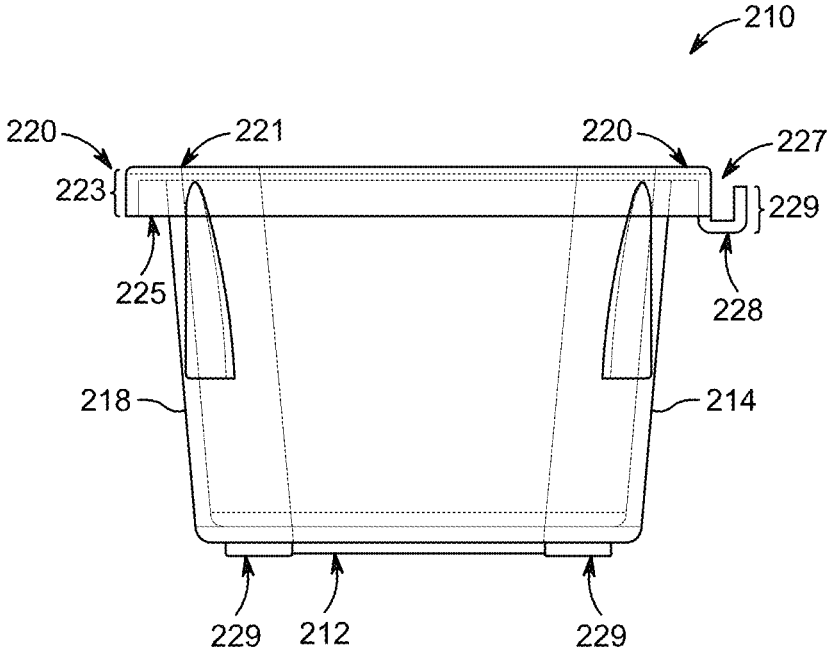
Figure 41:
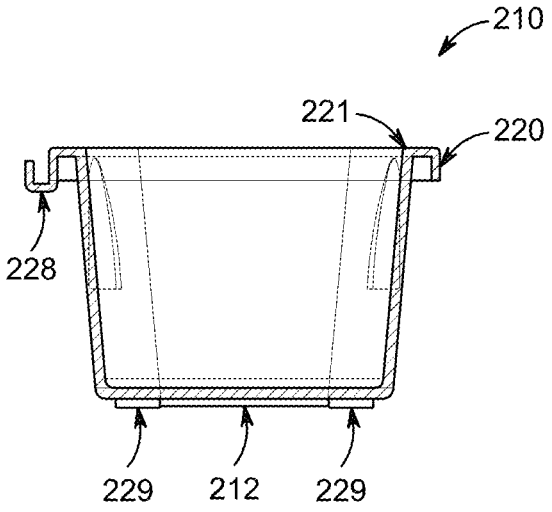
FIG. 41 is a right side elevational view of the 10th exemplary bin, showing an exemplary implementation thereof.
Figure 42:
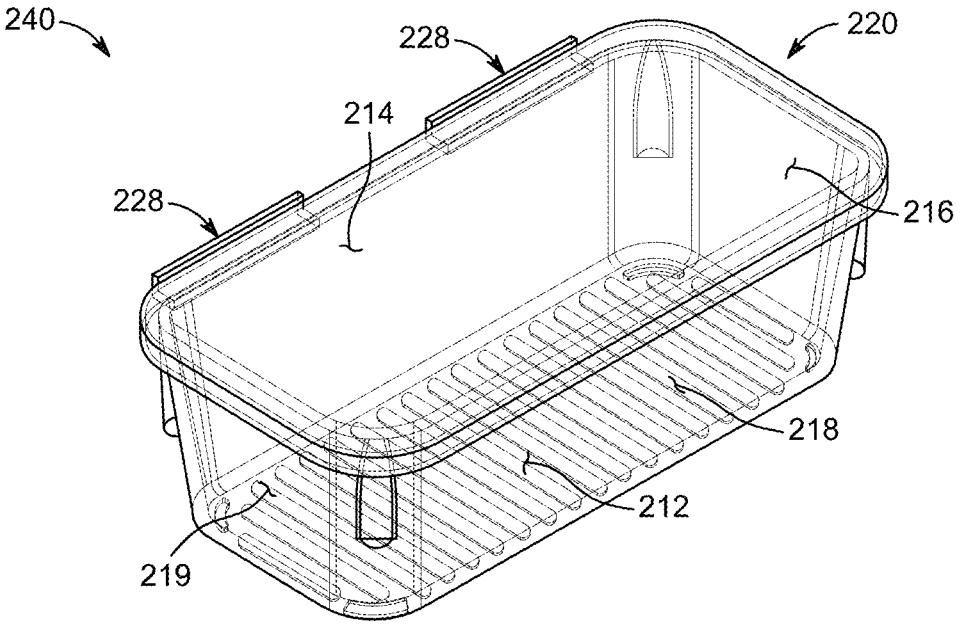
FIGS. 42-45 are various views of an eleventh exemplary bin according to the present application, i.e., a front/right/bottom perspective view (FIG. 42), a front elevational view (FIG. 43), a top plan view (FIG. 44), and a left side elevational view (FIG. 45) (a right side elevational view would be a mirror image thereof).
Figure 43:
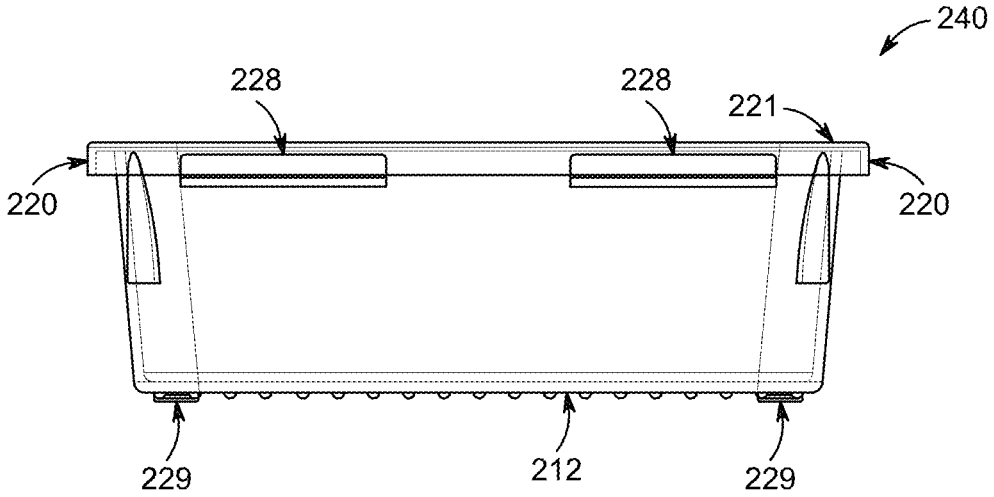
Figure 44:
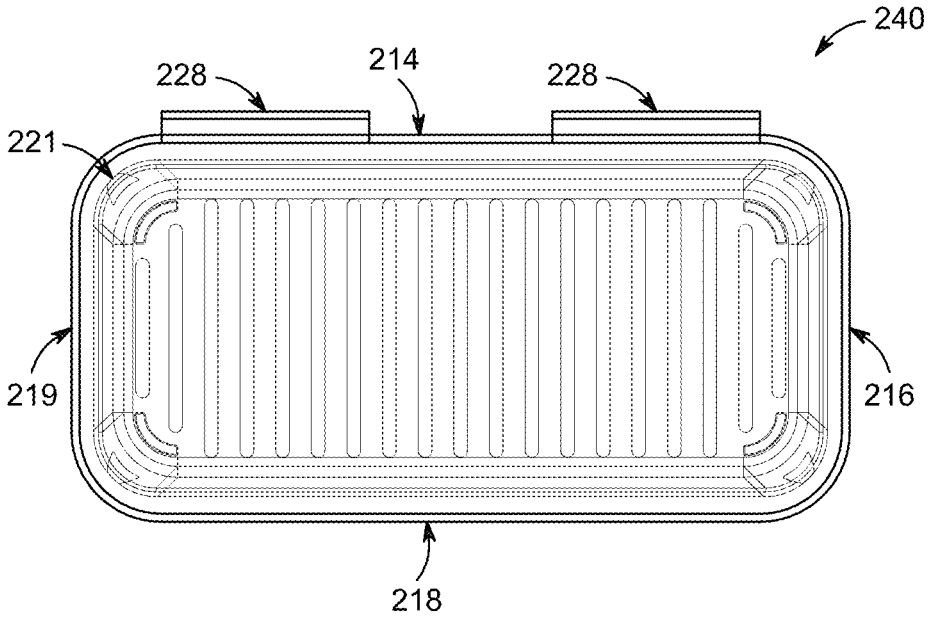
Figure 45:
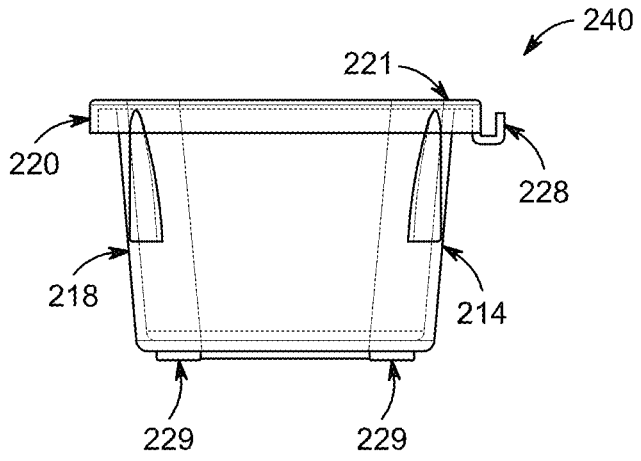

Referring now to FIG. 40, the exemplary male connector 228 is essentially an L-shaped flange that extends proximate the top 221 of the bin 210 extending from the female connector 220. In exemplary embodiments, the male connector 228 has the dimensions shown in the figures. Other configurations can be used that use the benefits of the present application. The exemplary female connector 220 is essentially an L-shaped flange extending from the top 221 of the bin 210 in by the respective sidewalls to receive the male connector 228 of another bin 210 to prevent relative motion of the connected bins. This configuration provides for female connector 220 to be smooth at the top 221 of the bin 210.

The opening 225 of the female connector 220 must be at least the same as or greater than the width 227 of the male connector 228 to allow a connection. In the exemplary embodiment, the opening 225 of the female connector 220 is 0.12 inches and the width 227 of the male connector 228 is 0.06 inches. The larger the difference between the opening 225 and the width 227 allows for a looser connection with more flexibility and, conversely, the closer the opening 225 is in size to the width 227, the more rigid the connection. In addition, the height 239 of the male connector 228 and the height 223 of the female connector 220 also affect the rigidity of the connection. As these heights, 223 and 239, are increased, the strength of the connection increases and, conversely, as these heights, 223 and 239, decrease, the strength of the connection decreases. Eventually, the heights will become relatively too short and the connection would not hold the bins 210 together. As the size of the bins 210 change, the height requirements would correspondingly change as well. Finally, the height 223 of the female connector 220 would ideally be a small amount taller than the height 239 of the male connector 228.

Figure 66:
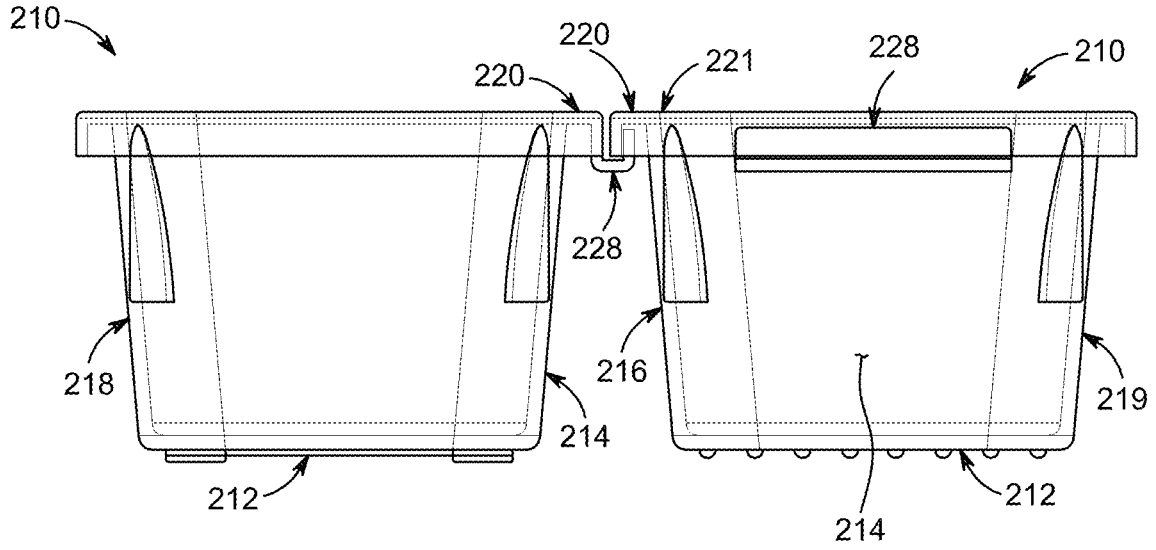
FIG. 66 is a side elevational view showing two bins of the second type connected side-by-side.

FIG. 66 is a side elevational view showing two of the second type of bins 210 connected side-by-side with the male connector 228 inside the female connector 220 on one side and with gravity acting upon the mass of the right bin to generate a downward force to hold the male connector 228 inside the female connector 220 to prevent lateral movement of the bins away from each other. In this particular embodiment, side 214 faces side 216. However, the bins could be rotated and various sides could face one another.

FIGS. 42-45 are various views of a second top side connecting exemplary bin 240 according to the present application. The second exemplary bin 240 is virtually identical to the first exemplary bin 210 except two of the side walls are longer and there are two male connectors on one of the longer sidewalls. Like exemplary bin 210, exemplary bin 240 is capable of connecting to other bins to prevent relative lateral movement and comprises a base 212 (in this case the bottom of the bin) having first, second, third, and fourth sides and a first wall 214, a second wall 216, a third wall 218, and a fourth wall 219 extending up from first, second, and third sides of the base 212. In this exemplary four-sided embodiment of FIGS. 42-45, one of the first side walls 214 and the top 221 of the female connector 220 connects to two male connectors 228. Connectors of the first type 220, such as a female connector 220, connect to connectors of the second type 228, such as a male connector 228, of other bins, to prevent relative lateral movement of connected bins. In some exemplary embodiments, the male connectors in bin 240 are the same as bin 210 (e.g. shown in FIG. 45) and the female connector of bin 240 are the same as bin 210 (e.g. shown in FIGS. 43, 45). In some exemplary embodiments, it is helpful to have the side walls of some bins be an integer multiplier of the length of the sidewalls of other bins. For example, the longer sidewalls of bin 240 in exemplary embodiments are about twice as long as the sidewalls of bin 210. This allows one bin 240 connect to two bins 210 to form a square.

Figure 46:
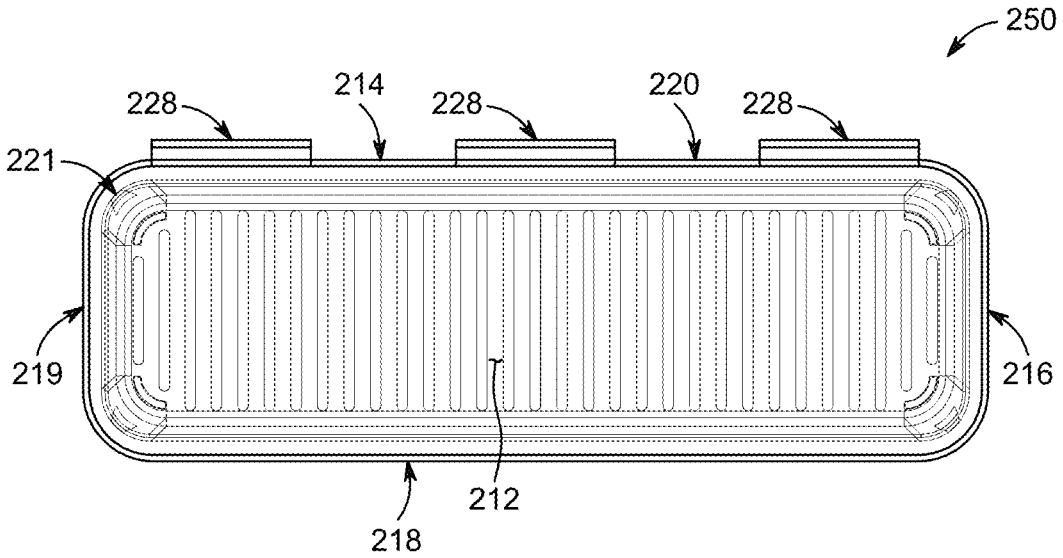
FIGS. 46-48 are various views of a twelfth exemplary bin according to the present application, i.e., a top plan view (FIG. 46), a front elevational view (FIG. 47), and a left side elevational view (FIG. 48) (a right side elevational view would be a mirror image thereof).
Figure 47:
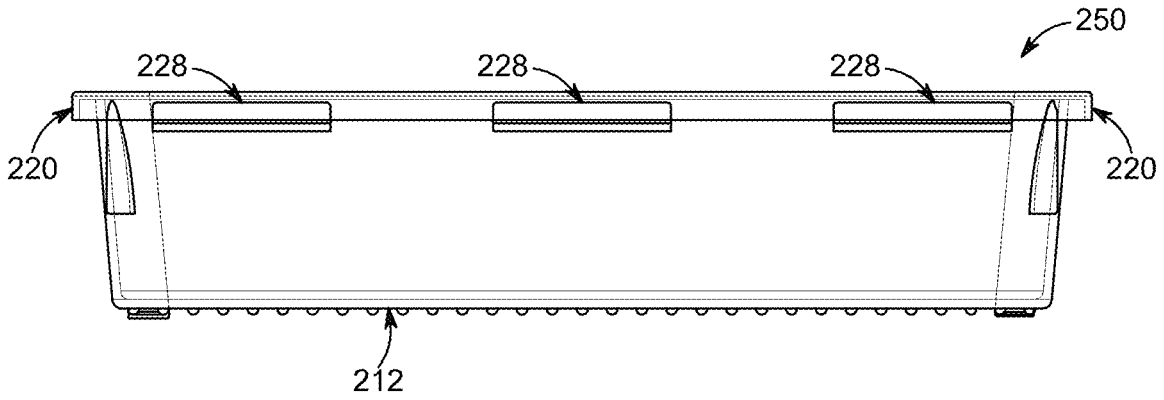
Figure 48:
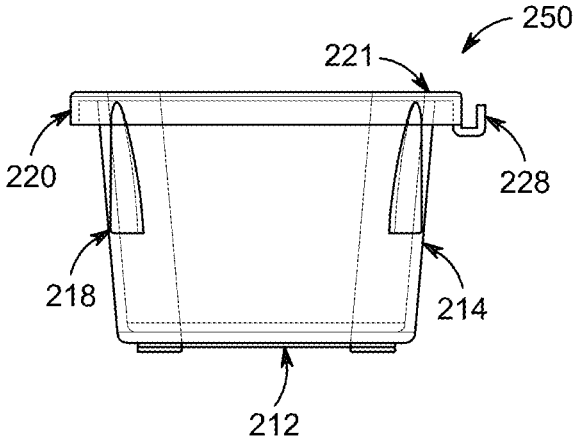

FIGS. 46-48 are various views of a third top side connecting exemplary bin 250 according to the present application. The third exemplary bin 250 is virtually identical to the first exemplary bin 210 except two of the side walls are longer and there are three male connectors 228 on one of the longer sidewalls. Like exemplary bin 210, exemplary bin 250 is capable of connecting to other bins to prevent relative lateral movement and comprises a base 212 (in this case the bottom of the bin) having first, second, third, and fourth sides and a first wall 214, a second wall 216, a third wall 218, and a fourth wall 219 extending up from first, second, and third sides of the base 212. In this exemplary four-sided embodiment of FIGS. 46-48, one of the first side walls 214 and the top 221 of the female connector 220 connects to three male connectors 228. Connectors of the first type 220, such as a female connector 220, connect to connectors of the second type 228, such as a male connector 228, of other bins, to prevent relative lateral movement of connected bins. In some exemplary embodiments, the male connectors in bin 250 are the same as bin 210 (e.g. shown in FIG. 45) and the female connector of bin 250 are the same as bin 210 (e.g. shown in FIGS. 43, 45). In some exemplary embodiments, it is helpful to have the side walls of some bins be an integer multiplier of the length of the sidewalls of other bins. For example, the longer sidewalls of bin 250 in exemplary embodiments are about three times as long as the sidewalls of bin 210. This allows one bin 250 connect to two bins 210 to form a square.

Figure 49:
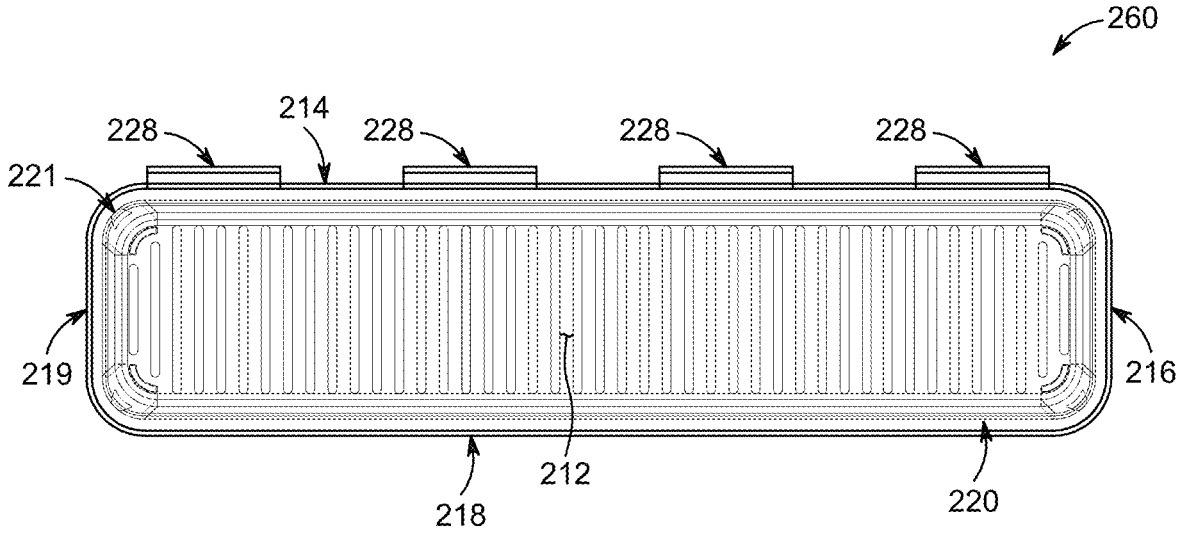
FIGS. 49-51 are various views of a thirteenth exemplary bin according to the present application, i.e., a top plan view (FIG. 49), a front elevational view (FIG. 50), and a left side elevational view (FIG. 51) (a right side elevational view would be a mirror image thereof).
Figure 50:
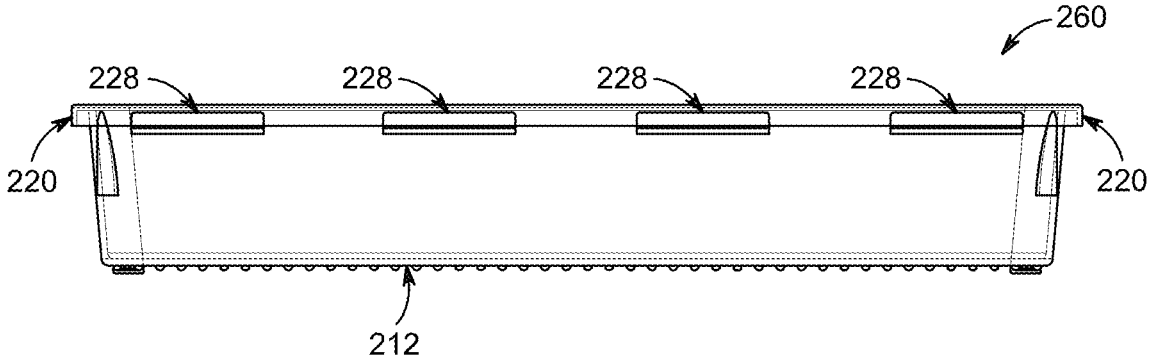
Figure 51:
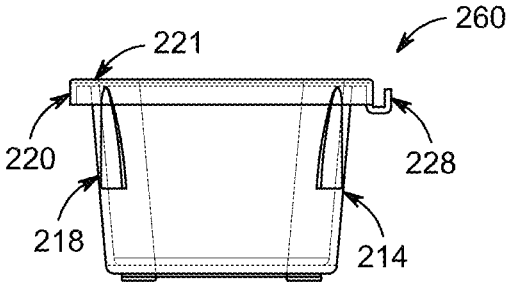

FIGS. 49-51 are various views of a fourth top side connecting exemplary bin 260 according to the present application. The fourth exemplary bin 260 is virtually identical to the first exemplary bin 210 except two of the side walls are longer and there are four male connectors 228 on one of the longer sidewalls. Like exemplary bin 210, exemplary bin 260 is capable of connecting to other bins to prevent relative lateral movement and comprises a base 212 (in this case the bottom of the bin) having first, second, third, and fourth sides and a first wall 214, a second wall 216, a third wall 218, and a fourth wall 219 extending up from first, second, and third sides of the base 212. In this exemplary four-sided embodiment of FIGS. 49-51, one of the first side walls 214 and the top 221 of the female connector 220 connects to four male connectors 228. Connectors of the first type 220, such as a female connector 220, connect to connectors of the second type 228, such as a male connector 228, of other bins, to prevent relative lateral movement of connected bins. In some exemplary embodiments, the male connectors in bin 260 are the same as bin 210 (e.g. shown in FIG. 45) and the female connector of bin 260 are the same as bin 210 (e.g. shown in FIGS. 43, 45). In some exemplary embodiments, it is helpful to have the side walls of some bins be an integer multiplier of the length of the sidewalls of other bins.

Figure 52:
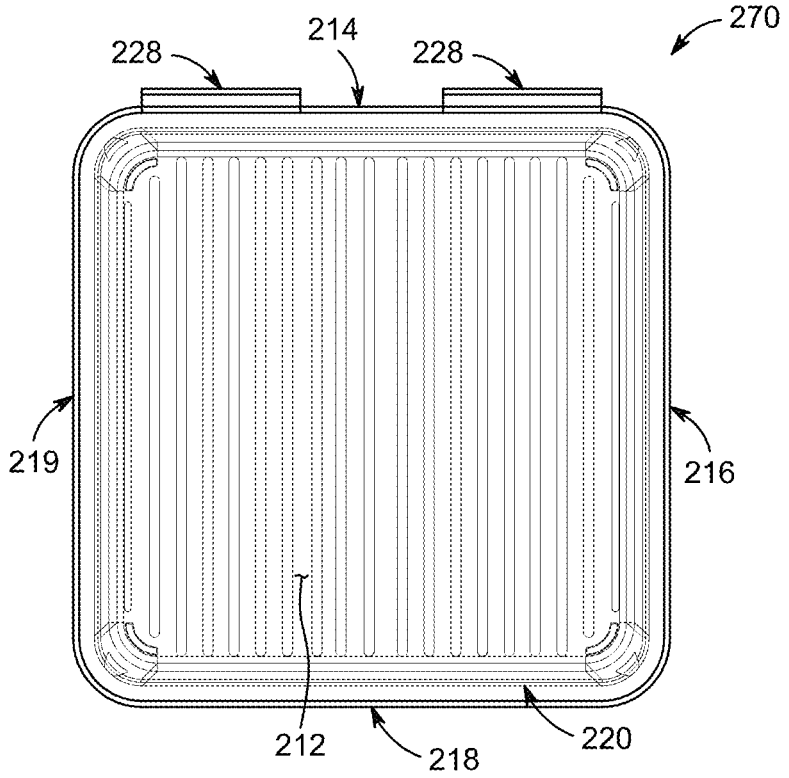
FIGS. 52-54 are various views of a fourteenth exemplary bin according to the present application, i.e., a top plan view (FIG. 52), a front elevational view (FIG. 53), and a left side elevational view (FIG. 54) (a right side elevational view would be a mirror image thereof).
Figure 53:
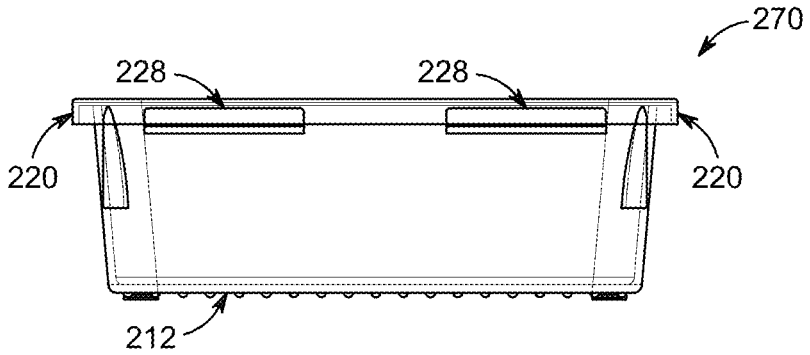
Figure 54:
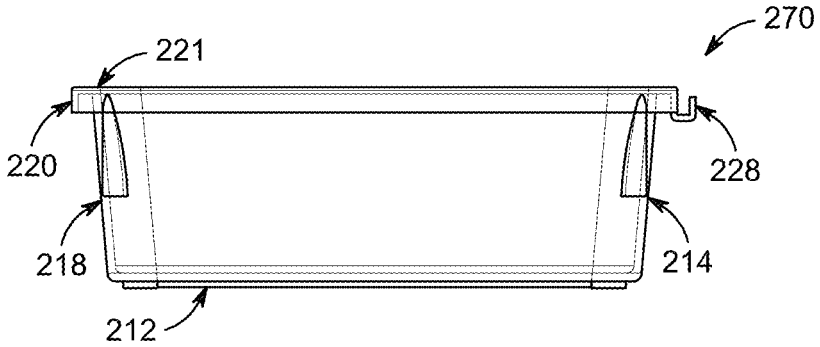

FIGS. 52-54 are various views of a fifth top side connecting exemplary bin 270 according to the present application. The fifth exemplary bin 270 is virtually identical to the first exemplary bin 210 except there are two male connectors 228 on one of the sidewalls instead of one male connector 228. Like exemplary bin 210, exemplary bin 270 is capable of connecting to other bins to prevent relative lateral movement and comprises a base 212 (in this case the bottom of the bin) having first, second, third, and fourth sides and a first wall 214, a second wall 216, a third wall 218, and a fourth wall 219 extending up from first, second, and third sides of the base 212. In this exemplary four-sided embodiment of FIGS. 52-54, one of the first side walls 214 and the top 221 of the female connector 220 connects to two male connectors 228. Connectors of the first type 220, such as a female connector 220, connect to connectors of the second type 228, such as a male connector 228, of other bins, to prevent relative lateral movement of connected bins. In some exemplary embodiments, the male connectors in bin 270 are the same as bin 210 (e.g. shown in FIG. 45) and the female connector of bin 270 are the same as bin 210 (e.g. shown in FIGS. 43, 45).

Figure 55:
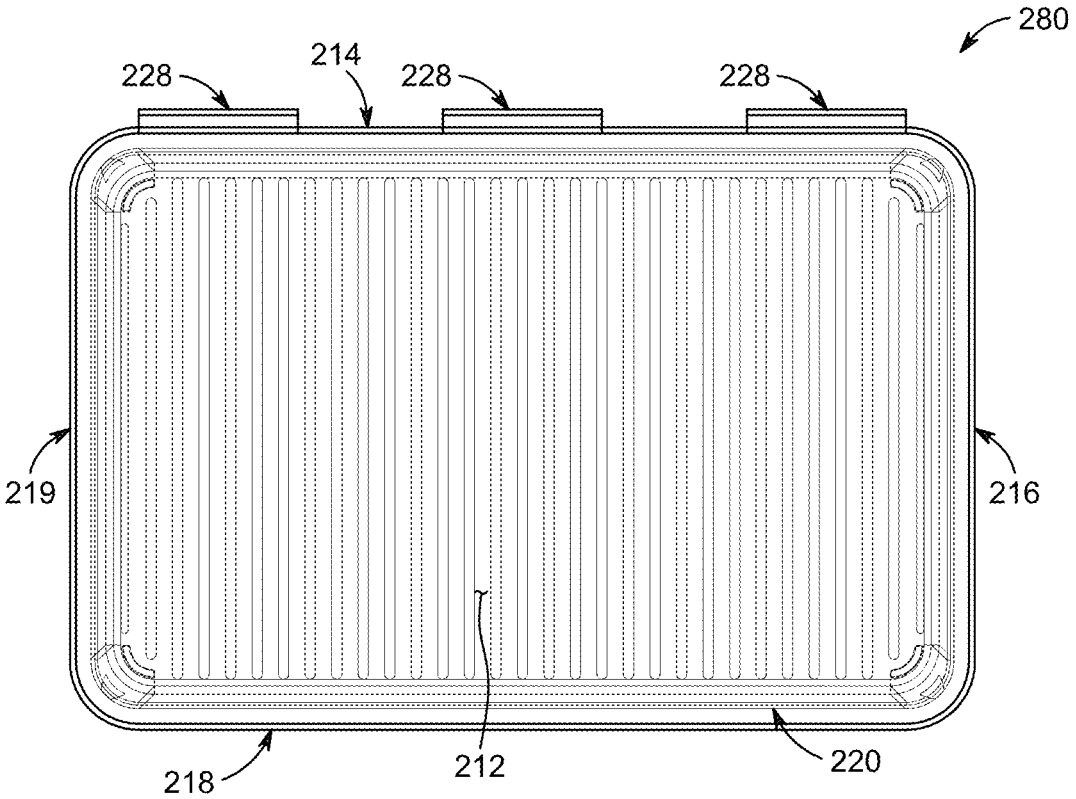
FIGS. 55-57 are various views of a fifteenth exemplary bin according to the present application, i.e., a top plan view (FIG. 55), a front elevational view (FIG. 56), and a left side elevational view (FIG. 57) (a right side elevational view would be a mirror image thereof).
Figure 56:
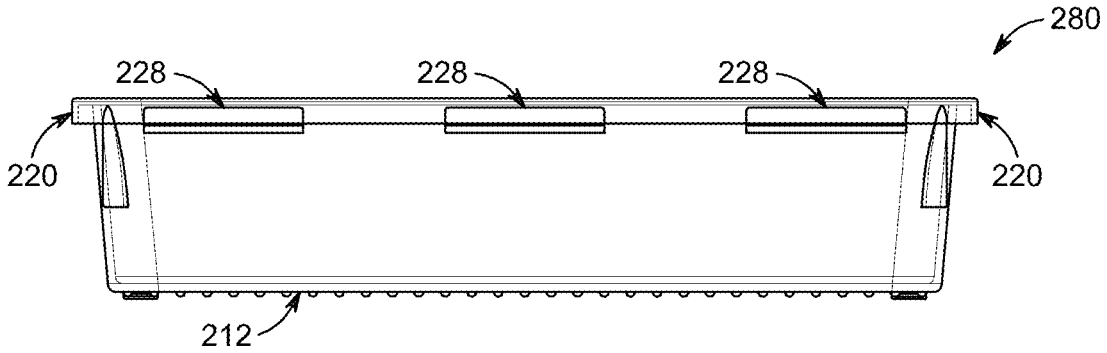
Figure 57:
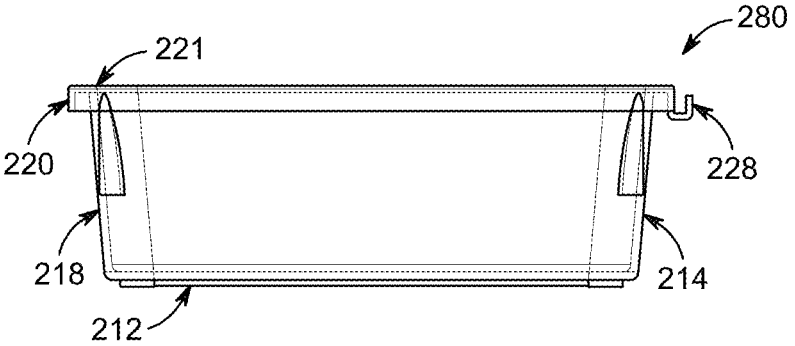

FIGS. 55-57 are various views of a sixth top side connecting exemplary bin 280 according to the present application. The sixth exemplary bin 280 is virtually identical to the first exemplary bin 210 except there are three male connectors 228 on one of the sidewalls instead of one male connector 228. Like exemplary bin 210, exemplary bin 280 is capable of connecting to other bins to prevent relative lateral movement and comprises a base 212 (in this case the bottom of the bin) having first, second, third, and fourth sides and a first wall 214, a second wall 216, a third wall 218, and a fourth wall 219 extending up from first, second, and third sides of the base 212. In this exemplary four-sided embodiment of FIGS. 55-57, one of the first side walls 214 and the top 221 of the female connector 220 connects to three male connectors 228. Connectors of the first type 220, such as a female connector 220, connect to connectors of the second type 228, such as a male connector 228, of other bins, to prevent relative lateral movement of connected bins. In some exemplary embodiments, the male connectors in bin 280 are the same as bin 210 (e.g. shown in FIG. 45) and the female connector of bin 280 are the same as bin 210 (e.g. shown in FIGS. 43, 45).

Figure 58:
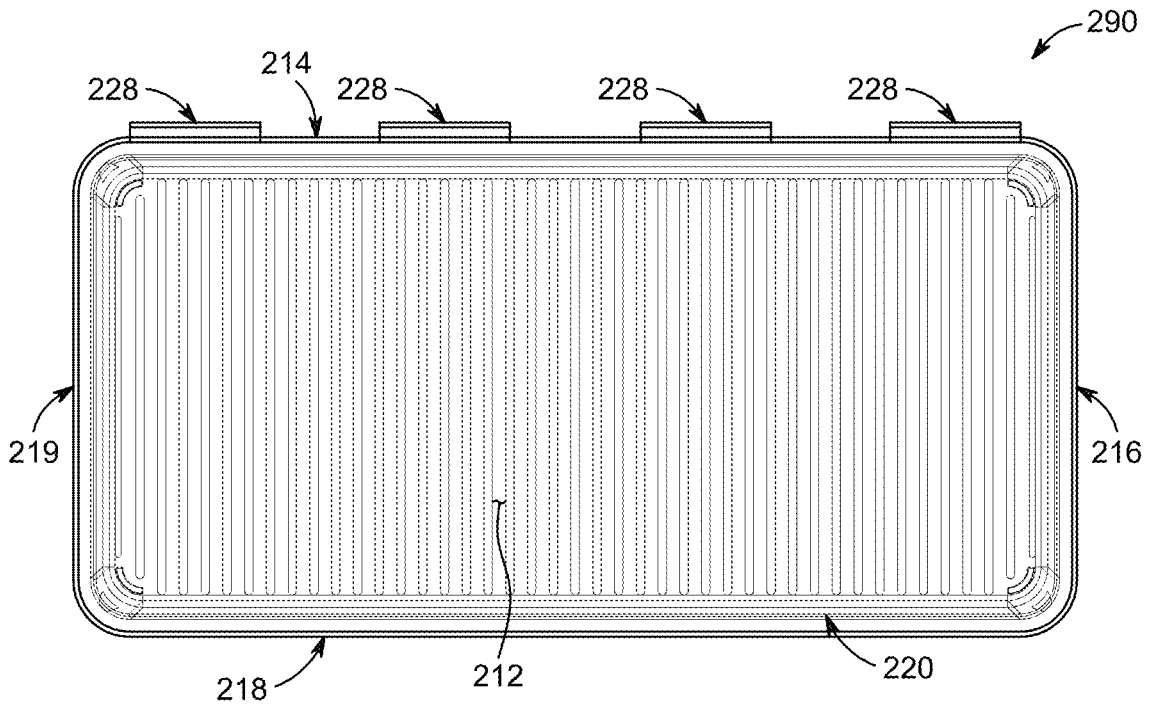
FIGS. 58-60 are various views of a sixteenth exemplary bin according to the present application, i.e., a top plan view (FIG. 58), a front elevational view (FIG. 59), and a left side elevational view (FIG. 60) (a right side elevational view would be a mirror image thereof).
Figure 59:
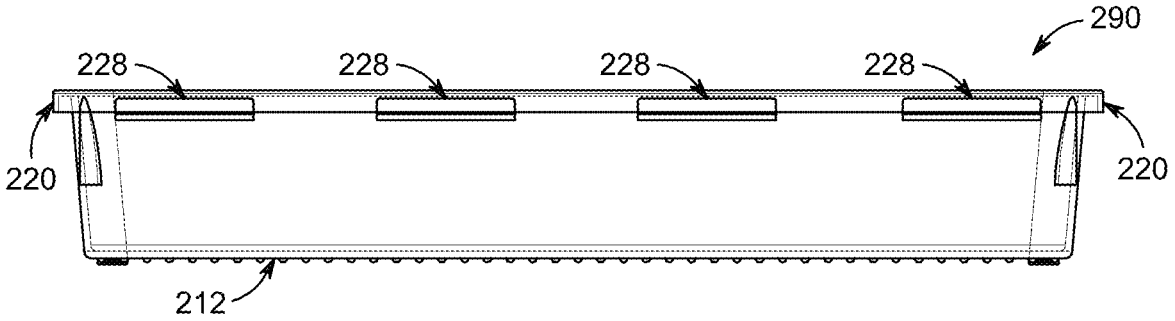
Figure 60:
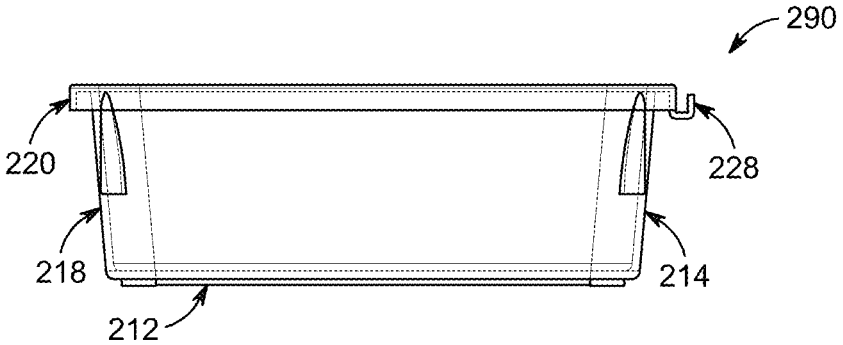

FIGS. 58-60 are various views of a seventh top side connecting exemplary bin 290 according to the present application. The seventh exemplary bin 290 is virtually identical to the first exemplary bin 210 except there are four male connectors 228 on one of the sidewalls instead of one male connector 228. Like exemplary bin 210, exemplary bin 290 is capable of connecting to other bins to prevent relative lateral movement and comprises a base 212 (in this case the bottom of the bin) having first, second, third, and fourth sides and a first wall 214, a second wall 216, a third wall 218, and a fourth wall 219 extending up from first, second, and third sides of the base 212. In this exemplary four-sided embodiment of FIGS. 58-60, one of the first side walls 214 and the top 221 of the female connector 220 connects to four male connectors 228. Connectors of the first type 220, such as a female connector 220, connect to connectors of the second type 228, such as a male connector 228, of other bins, to prevent relative lateral movement of connected bins. In some exemplary embodiments, the male connectors in bin 290 are the same as bin 210 (e.g. shown in FIG. 45) and the female connector of bin 290 are the same as bin 210 (e.g. shown in FIGS. 43, 45).

Figure 61:
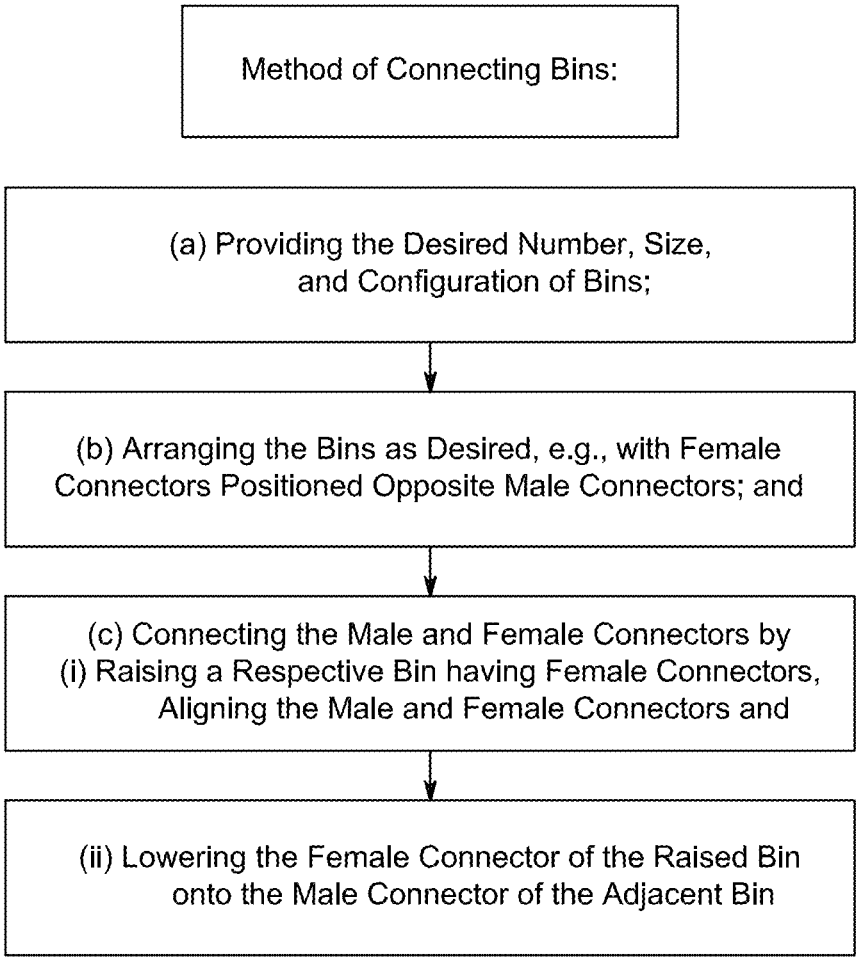
FIG. 61 is a flow chart showing another exemplary method.

FIG. 61 is a flow chart showing an exemplary method of connecting bins according to the present application.

Figure 62:
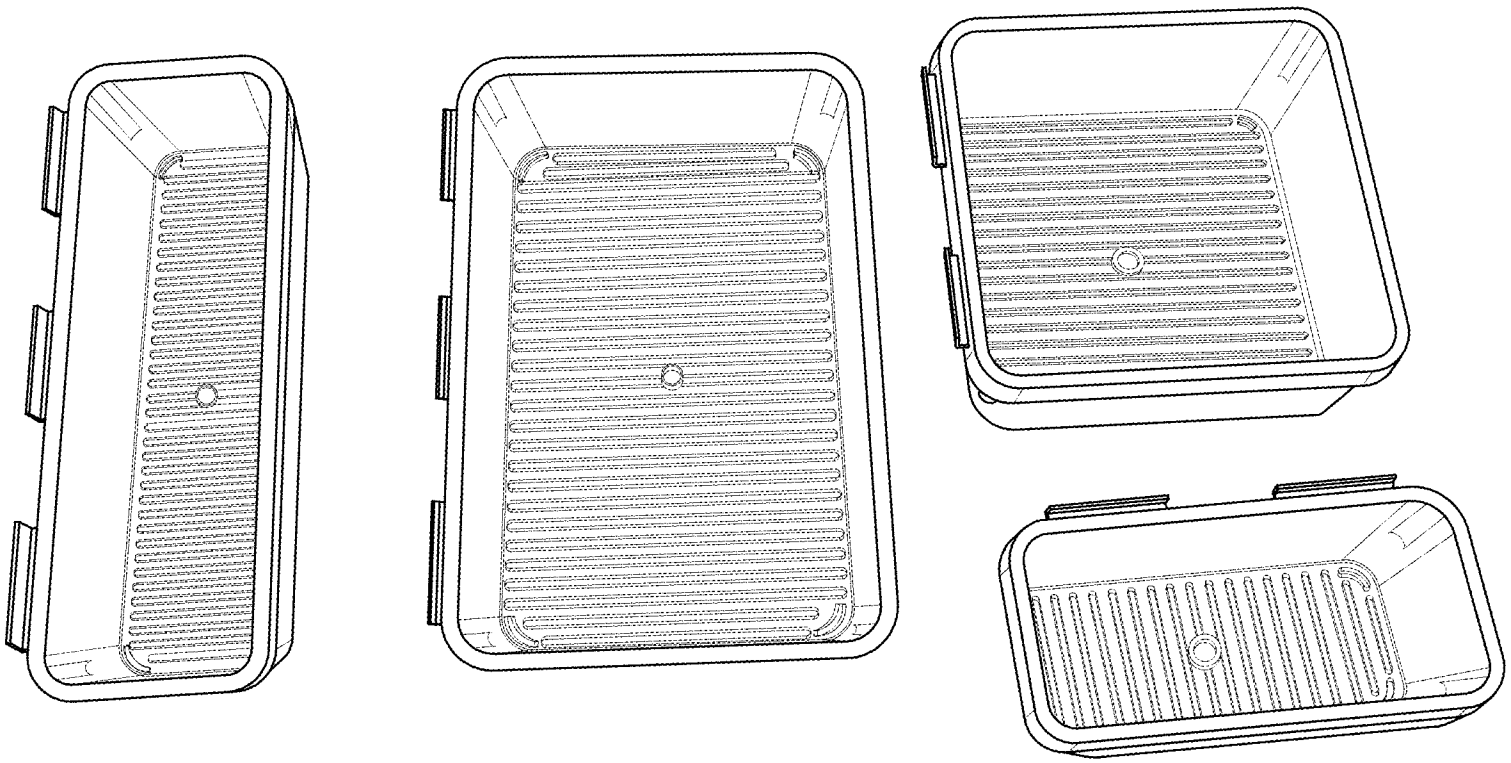
FIGS. 62-64 show arrangements of bins exemplifying the method of FIG. 30.
Figure 63:
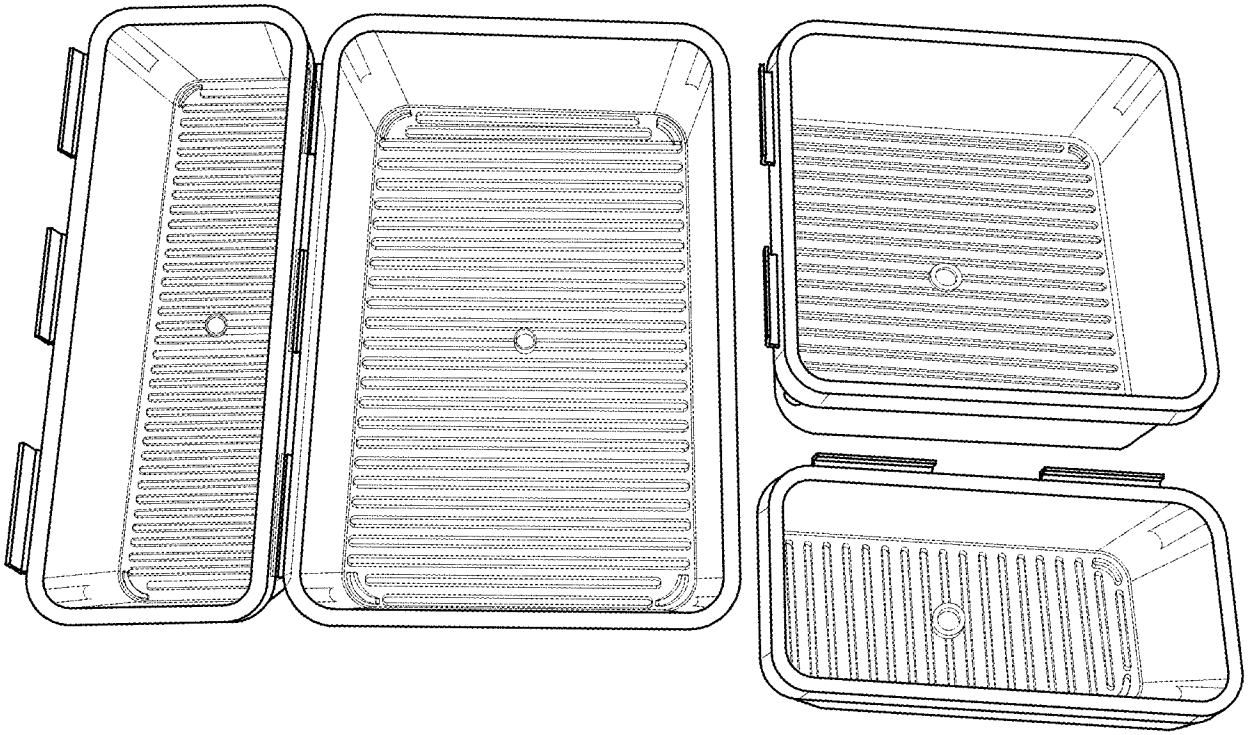
Figure 64:
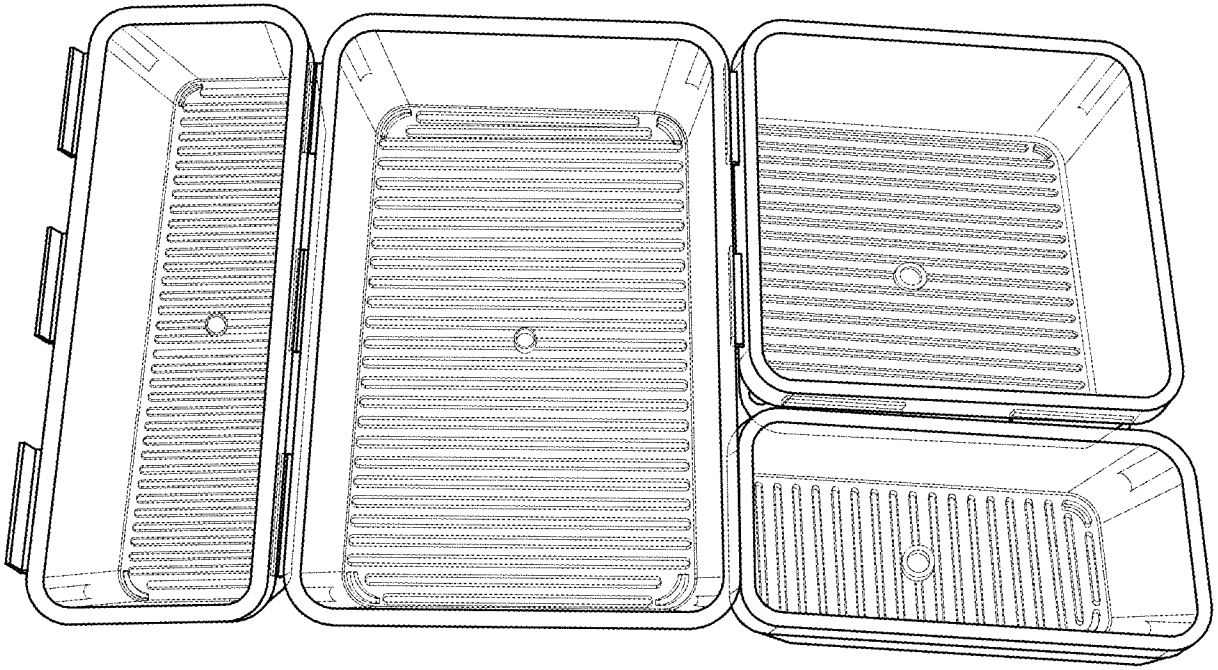

FIGS. 62-64 show arrangements of bins exemplifying the method of FIG. 61.

As mentioned above, exemplary three-sided bins have female connector on two sides and a male connector on the third side. Depending on the arrangement of bins, this might result in two female connectors being adjacent and unconnected, e.g., ten (10) triangular bins with one male connector 28 per bin extending from one side. In exemplary embodiments, a clip can be used to connect to adjacent female connectors, thereby preventing lateral movement of the adjacent bins. For example, a piece consisting of two of the male connectors 28 from FIGS. 1-35 connected end to end (e.g., integrally molded) and used to connect to adjacent female connectors, thereby preventing lateral movement of the adjacent bins. The male connectors can either snap in or simply use gravity to be held in place, like the other examples in FIGS. 1-35, or use other means for connecting, e.g., adhesive, ultrasonic welding, fasteners, threaded fasteners, etc. For example, a piece consisting of two of the male connectors 28 from FIGS. 1-35 connected end to end (e.g., integrally molded) and used to connect to adjacent female connectors, thereby preventing lateral movement of the adjacent bins. The male connectors can either snap in or simply use gravity to be held in place, like the other examples in FIGS. 1-35, or use other means for connecting, e.g., adhesive, ultrasonic welding, fasteners, threaded fasteners, etc. As another example, a piece consisting of two of the male connectors 228 from FIGS. 36-64 connected end to end (e.g., integrally molded) and used to connect to adjacent female connectors, thereby preventing lateral movement of the adjacent bins. The male connectors can either snap in or use other means for connecting, e.g., adhesive, ultrasonic welding, fasteners, threaded fasteners, etc. In alternate embodiments, bins of the type in FIGS. 36-64 can be made without male connectors 228 but with separate double male connectors to clip the flanges 220 together where needed.

As described herein, when one or more components are described as being connected, joined, affixed, coupled, attached, or otherwise interconnected, such interconnection may be direct as between the components or may be indirect such as through the use of one or more intermediary components.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. For example, although the exemplary bins shown are held in an arranged configuration by gravity holding the bins with the female connectors overlapping with the male connectors, other means for keeping them from becoming separated can be used, such as the male and female connectors clipping together, using friction fit between the male and female connectors, using an adhesive between the male and female connectors, using fasteners, using threaded fasteners, etc. Moreover, elements described with one embodiment may be readily adapted for use with other embodiments. Therefore, the invention, in its broader aspects, is not limited to the specific details, the representative apparatus and/or illustrative examples shown and described. Accordingly, departures may be made from such details without departing from the spirit or scope of the applicants' general inventive concept.

What is claimed is:

1. A bin capable of connecting to other bins to prevent relative lateral movement comprising:

a base having at least first, second, third, and fourth sides;

at least first, second, and third side walls extending up from first, second, and third sides of the base;

wherein one of the first side wall and the base on the first side has at least one first connector of a first type;

wherein one of the second side wall and the base on the second side has at least one second connector of the first type;

wherein one of the third side wall and the base on the third side has at least one third connector of the first type;

wherein one of the base on its fourth side and an optional fourth side wall has at least one connector of a second type, wherein connectors of the first type connect to connectors of the second type to prevent relative lateral movement of connected bins, such that the fourth side and optional fourth side wall are adjacent at least one of the first, second, or third sides and sidewalls of another bin;

wherein at least one connector of the first or second type is a male connector protruding beyond the side or side wall, wherein the other at least one connector of the first or second type is a female connector; and wherein the first and second connectors are configured such that, when one of the male connectors of a first bin is interlocked with one of the female connectors of a second bin, the male connector is not upwardly moveable beyond the female connector and the side wall of the second bin is disposed between the male connector of the first bin and the side wall of the first bin; and wherein the one male connector of the first bin is interlocked with the one female connector of the second bin only adjacent the bases of the first and second bins.

2. The bin according to claim 1, wherein the first connector of the first type is a female connector; and wherein the first, second, and third side walls each have a bottom; and wherein the female connectors are recessed within the first, second, and third side walls and formed only adjacent the bottom of the bin by a gap adjacent the bottom of the first, second, and third side walls.

3. The bin according to claim 1, wherein the first connector of the first type is a female connector; and wherein the female connectors each have a top wall adjacent the bottom of the bin.

4. A bin capable of connecting to other bins to prevent relative lateral movement comprising:

a base having at least first, second, and third sides;

at least first and second side walls extending up from the first and second sides of the base, each side wall having an exterior surface;

wherein one of the first side wall and the base on the first side has at least one first connector of a first type;

wherein one of the second side wall and the base on the second side has at least one second connector of the first type;

wherein one of the base on its third side and an optional third side wall has at least one connector of a second type, wherein connectors of the first type connect to connectors of the second type to prevent relative lateral movement of connected bins; and wherein either the first connector of the first type or the at least one connector of the second type comprises a female connector recessed within the exterior surface formed only adjacent a bottom of the bin by a gap adjacent a bottom of the exterior surface.

5. The bin according to claim 4, wherein the first connector of the first type is a female connector recessed within the exterior surface and wherein the female connectors also have a top wall adjacent the bottom of the bin.

6. The bin according to claim 4, wherein the first connector of the second type is a male connector protruding beyond a respective exterior surface; and wherein the connector of the first type is a female connector recessed within the exterior surface and wherein the female connectors also have a top wall adjacent the bottom of the bin.

7. The bin according to claim 4:

wherein the connector of the first type is a female connector recessed within a respective planar exterior surface;

wherein the connector of the second type is a male connector protruding beyond a respective planar exterior surface;

wherein the base on the first side has a plurality of female connectors, each recessed within a respective planar exterior surface;

wherein the base on the second side has at least one female connector recessed within a respective planar exterior surface;

wherein the base on the third side has a plurality of male connectors, each protruding beyond a respective planar exterior surface; and wherein the male connectors connect to the female connectors to prevent relative lateral movement of adjacent connected bins.

8. The bin according to claim 4:

wherein the base has at least first, second, third, and fourth sides;

further comprising at least third and fourth side walls extending up from the third and fourth sides of the base, each side wall having a planar exterior surface;

wherein the connector of the first type is a female connector recessed within a respective planar exterior surface;

wherein the connector of the second type is a male connector protruding beyond a respective planar exterior surface;

wherein the base on the first side has a plurality of female connectors, each recessed within a respective planar exterior surface;

wherein the base on the second side has at least one female connector recessed within a respective planar exterior surface;

wherein the base on the third side has a plurality of male connectors, each protruding beyond a respective planar exterior surface;

wherein the base on the fourth side has a plurality of female connectors, each recessed within a respective planar exterior surface; and wherein the male connectors connect to the female connectors of an adjacent bin to prevent relative lateral movement of connected bins.

9. The bin according to claim 1, wherein each male connector has a proximal portion that extends outward parallel to the base and a distal portion that extends perpendicular to the proximal portion.

10. The bin according to claim 1, wherein each male connector has a proximal portion that extends horizontally outward and a distal portion that extends vertically upward.

11. The bin according to claim 9, wherein each male connector comprises an L-shaped cross-section formed by (a) the proximal portion extending outward parallel to the base and (b) the distal portion extending perpendicular to the proximal portion.

12. The bin according to claim 1, wherein each female connector defines a chamber which extends inwardly from the side or side wall and upwardly from the base.

13. The bin according to claim 1, wherein each female connector defines a chamber which extends horizontally inward and vertically upward.

14. The bin according to claim 4, wherein each female connector defines a chamber which extends inwardly from the exterior surface and upwardly from the base.

15. The bin according to claim 6, wherein each male connector has a proximal portion that extends outward parallel to the base and a distal portion that extends perpendicular to the proximal portion.

16. The bin according to claim 13, wherein each male connector comprises an L-shaped cross-section formed by (a) the proximal portion extending outward parallel to the base and (b) the distal portion extending perpendicular to the proximal portion.

* * * * *